US011732403B2

(12) United States Patent
Noor et al.

(10) Patent No.: US 11,732,403 B2
(45) Date of Patent: Aug. 22, 2023

(54) METHOD FOR SONOCHEMICAL DEPOSITION OF METALS ON TEXTILE SUBSTRATES

(71) Applicant: THE HONG KONG POLYTECHNIC UNIVERSITY, Hong Kong (CN)

(72) Inventors: Nuruzzaman Noor, Hong Kong (CN); Suhas Mutalik, Hong Kong (CN)

(73) Assignee: THE HONG KONG POLYTECHNIC UNIVERSITY, Hong Kong (CN)

( * ) Notice: Subject to any disclaimer, the term of this patent is extended or adjusted under 35 U.S.C. 154(b) by 891 days.

(21) Appl. No.: 16/574,132

(22) Filed: Sep. 18, 2019

(65) Prior Publication Data

US 2020/0087849 A1 Mar. 19, 2020

Related U.S. Application Data

(60) Provisional application No. 62/733,170, filed on Sep. 19, 2018.

(51) Int. Cl.

| | |
|---|---|
| ***D06M 10/02*** | (2006.01) |
| ***D06M 11/44*** | (2006.01) |
| ***D06M 23/08*** | (2006.01) |
| ***D06M 23/10*** | (2006.01) |
| ***D06M 11/46*** | (2006.01) |

(52) U.S. Cl.

CPC ..... *D06M 10/02* (2013.01); *D06M 11/44* (2013.01); *D06M 11/46* (2013.01); *D06M 23/08* (2013.01); *D06M 23/10* (2013.01); *D06M 2200/10* (2013.01)

(58) Field of Classification Search

CPC ..... D06M 10/02; D06M 11/44; D06M 11/46; D06M 23/08; D06M 23/10; D06M 2200/10

USPC ..... 442/59

See application file for complete search history.

(56) References Cited

PUBLICATIONS

In situ formation deposited ZnO nanoparticles on silk fabrics under ultrasound irradiation, Somayeh Khanjani et al., May 4, 2012, Ultrasonics Sonochemistry 20 734-739 (Year: 2012).*

Antibacterial Properties of an In Situ Generated and Simultaneously Deposited Nanocrystalline ZnO on Fabrics, I. Perelshtein et al., Applied Materials & Interfaces vol. 1 No. 2 361-366, 2009 (Year: 2009).*

A review on textile sonoprocessing: A special focus on sonosynthesis of nanomaterials on textile substrates, Tina Harifi et al., Jul. 28, 2014, Ultrasonics Sonochemistry 23 1-10 (Year: 2014).*

Sonochemical coating of silver nanoparticles on textile fabrics (nylon, polyester and cotton) and their antibacterial activity, Perelshtein et al., 2008, Nanotechnology 19 (Year: 2008).*

Inactivation of Bacterial Spores and Vegetative Bacterial Cells by Interaction with ZnO—Fe2O3 Nanoparticles and UV Radiation, Sanchez-Salas et al., AIMS Geosciences, 3 (4): 498-513, Sep. 22, 2017 (Year: 2017).*

(Continued)

*Primary Examiner* — Vincent Tatesure

(74) *Attorney, Agent, or Firm* — Spruson & Ferguson (Hong Kong) Limited

(57) ABSTRACT

Provided herein are methods for preparing metal coated textile substrate by ultrasonic irradiation deposition processes and products thereof.

5 Claims, 13 Drawing Sheets

(56) References Cited

PUBLICATIONS

Jeon et al.; Growth behaviors and film properties of zinc oxide grown by atmospheric mist chemical vapor deposition; Journal of Alloys and Compounds; 2014; pp. 244-248; vol. 614; Elsevier.
Perelshtein et al.; Sonochemical co-deposition of antibacterial nanoparticles and dyes on textiles; Journal of Nanotechnology; 2016; pp. 1-8; vol. 7; Beilstein.
Salmatonidis et al.; Chemical Cross-Linking of Anatase Nanoparticle Thin Films for Enhanced Mechanical Properties; Langmuir; 2018; vol. 34; pp. 6109-6116; ACS Publications.
Beneq; Atomic Layer Deposition; https://beneq.com/en/thin-films/technology/atomic-layer-deposition.
Noor et al.; Influencing FTO thin film growth with thin seeding layers: a route to microstructural modification; Journal of Materials Chemistry C; 2015; pp. 9359-9368; The Royal Society of Chemistry.
Wu et al.; A versatile and efficient method to fabricate durable superhydrophobic surfaces on wood, lignocellulosic fiber, glass, and metal substrates; Journal of Materials Chemistry C; 2016; vol. 4; pp. 14111-14121; The Royal Society of Chemistry.
Munch et al.; Smart functional polymer coatings for paper with anti-fouling properties; Journal of Materials Chemistry B; 2018; vol. 6; pp. 830-843; The Royal Society of Chemistry.
Cheng et al.; Vapor phase organic chemistry to deposit conjugated polymer films on arbitrary substrates; Journal of Materials Chemistry C; 2017; vol. 5; pp. 5787-5796; The Royal Society of Chemistry.
Jiao et al.; Fly-through synthesis of nanoparticles on textile and paper substrates; Nanoscale; 2019; vol. 11; pp. 6174-6181; The Royal Society of Chemistry.
Jain et al.; Mixed-Valence Perovskite Thin Films by Polymer-Assisted Deposition; Journal of the American Ceramic Society; 2008; vol. 91, Issue 6; pp. 1858-1863; Wiley.

* cited by examiner

METHOD FOR SONOCHEMICAL DEPOSITION OF METALS ON TEXTILE SUBSTRATES

CROSS-REFERENCE TO RELATED APPLICATIONS

This application claims the benefit of priority of U.S. Provisional Patent Application No. 62/733,170, filed on Sep. 19, 2018, the contents of which being hereby incorporated by reference in their entirety for all purposes.

TECHNICAL FIELD

The present disclosure generally relates to a method for preparing metal coated textile substrates using ultrasonic irradiation deposition processes and products thereof.

BACKGROUND

Wearable technologies in the form of durable and functional apparel are increasingly becoming an integral part of human lifestyles. Increasing customer demand for durable and functional apparel manufactured in a sustainable manner has created an opportunity for nanomaterials to be integrated (e.g. via nano- and/or micro-particle (NMP) incorporation) into textile substrates. Functionalities, such as controlling wettability for water-repellency or 'sheeting' properties of the integrated nanomaterials, have potential applications in recreational clothing, protective clothing, medical textiles, electronic skins, reversible biosensors, etc.

Metal oxides can have excellent chemical stability, with the added benefit of being stable under humid conditions. Thus, they can retain functionality when exposed to rain, sweat, moisture, etc. However, their use on washable and re-usable functional textiles has always been limited by the fact that; i) their processing requires temperatures greater than the glass and/or thermal decomposition temperature of the textile substrate materials, and; ii) problems of leaching/sloughing due to poor washfastness, and the significant loss of NMPs from the treated textile substrate upon laundering (more so when exposed to strong oxidizing agents, such as bleaches), although leaching extent can be dependent on the physical chemical properties of the textile substrate.

A major problem of conventional methods for metal deposition on textile substrates is that water soluble NMPs cannot usually be firmly deposited on textiles substrates. This can be due to poor washfastness of the metal coated textile substrate resulting from low adhesive strength of coating or high water solubility of the coated metal. Removal of the metal coating from the textile results in a decrease in the desired functional properties over repeated washings. Another problem with bound NMPs (such as Ag and/or ZnO) is abrasion from textile fibers or even deactivation, i.e.; long term durability and functional performance issues. These sloughing effects raise concerns about potential metal NMP leaching, environmental impact, and potential toxicity due to extended exposure to the leached/sloughed metal coating. Thus, manufacturing methods that allow durable NMPs incorporation onto textile substrates whilst also minimizing leaching are of great commercial and academic interest.

There are various methods for the preparation of metal nanoparticles. Most of these methods, including those that are used industrially at present, typically require harsh manufacturing conditions, such as high-temperature, high-pressure, and/or time consuming synthetic procedures (i.e. often several hours to several days). Current coating techniques also have serious scalability limitations due in part to time-consuming procedures, many of which are only feasible at lab scale.

Thus, there is a need for improved methods for preparing metal coated textile substrates that solve one or more of the aforementioned problems.

SUMMARY

Accordingly, it is an object of the present disclosure to provide a method for preparing metal coated textiles substrates with improved resistance to leeching and sloughing. The properties of the metal coated metal substrates can be modified by appropriate selection of reaction conditions and selection of starting materials affording multi-functional metal coated textiles.

In a first aspect, provided herein is a method for preparing a metal coated textile substrate comprising: depositing a first plurality of metal nanoparticles on a textile substrate by a first ultrasonic irradiation deposition process thereby forming a metal seeded textile substrate; and depositing a second plurality of metal nanoparticles on the metal seeded textile substrate by a second ultrasonic irradiation deposition process thereby forming the metal coated textile substrate.

In a first embodiment of the first aspect, provided herein is the method of the first aspect, wherein the textile substrate comprises a natural fiber, a synthetic fiber, or a combination thereof.

In a second embodiment of the first aspect, provided herein is the method of the first aspect, wherein the first ultrasonic irradiation deposition process and the second ultrasonic irradiation deposition process independently comprise ultrasonic wave irradiation at a frequency of at least 20 kHz and a power of 700 to 800 W at between 10% and 60% ultrasound amplitude.

In a third embodiment of the first aspect, provided herein is the method of the first aspect, wherein the first plurality of metal nanoparticles is selected from the group consisting of Ag, Au, Pt, Pd, Ni, Cu, $Ag_2S$, $TiO_2$, $SnO_2$, ZnO, and $Al_2O_3$.

In a fourth embodiment of the first aspect, provided herein is the method of the first aspect, wherein the second plurality of metal nanoparticles is selected from the group consisting of ZnO, CuO, $Cu_2O$, $TiO_2$, $SnO_2$, $Fe_2O_3$, and $Fe_3O_4$.

In a fifth embodiment of the first aspect, provided herein is the method of the first aspect, wherein the first plurality of metal nanoparticles are prepared by reaction of a first metal precursor and a first metal precursor reactant, wherein the first metal precursor is silver nitrate and the first metal precursor reactant is $NaBH_4$, ethylene glycol, or polyethylene glycol; the first metal precursor is $AgNO_3$ and the first metal precursor reactant is a citrate salt and a thiosulfate salt; or the first metal precursor is $AlCl_3$ and the first metal precursor reactant is an alkali metal hydroxide.

In a sixth embodiment of the first aspect, provided herein is the method of the first aspect, wherein the second plurality of metal nanoparticles are prepared by reaction of a second metal precursor and a second metal precursor reactant, wherein the second metal precursor is $Zn(OAc)_2$, $Zn(NO_3)_2$, or $Cu(NO_3)_2$, and the second metal precursor reactant is an alkali metal hydroxide, ammonia, or a combination thereof or the second metal precursor is $TiCl_4$ or $Ti(OR)_4$, wherein R is $C_1$-$C_6$ alkyl, and the second metal precursor reactant is water.

In a seventh embodiment of the first aspect, provided herein is the method of the first aspect, wherein the step of depositing a second plurality of metal nanoparticles on the metal seeded textile substrate further comprises co-depositing a metal dopant with the second plurality of metal nanoparticles.

In an eighth embodiment of the first aspect, provided herein is the method of the seventh embodiment of the first aspect, wherein the metal dopant is selected from the group consisting of $Fe_2O_3$ and $Fe_3O_4$.

In a ninth embodiment of the first aspect, provided herein is the method of the first aspect, wherein the method for preparing the metal coated textile substrate comprises: providing a seeding solution comprising a first metal precursor and a first metal precursor reactant; irradiating the seeding solution by a first ultrasonic irradiation reaction process thereby forming a first plurality of metal nanoparticles; depositing the first plurality of metal nanoparticles on a textile substrate by a first ultrasonic irradiation deposition process thereby forming a metal seeded textile substrate; providing a coating solution comprising a second metal precursor and a second metal precursor reactant; irradiating the coating solution by a second ultrasonic irradiation reaction process thereby forming a second plurality of metal nanoparticles; and depositing the second plurality of metal nanoparticles on the metal seeded textile substrate by a second ultrasonic irradiation deposition process thereby forming the metal coated textile substrate.

In a tenth embodiment of the first aspect, provided herein is the method of the ninth embodiment of the first aspect, wherein the first metal precursor is $AgNO_3$ and the first metal precursor reactant is ethylene glycol, wherein the $AgNO_3$ is present in the seeding solution at a concentration of 0.005 M to 0.050 M and the ethylene glycol is present in the seeding solution at a concentration of 40-80% v/v.

In an eleventh embodiment of the first aspect, provided herein is the method of the ninth embodiment of the first aspect, wherein the second metal precursor is $Zn(OAc)_2$ and the second metal precursor reactant is an alkali metal hydroxide, wherein the $Zn(OAc)_2$ is present in the coating solution at a concentration of 0.02 M to 0.2 M and the concentration of the alkali metal hydroxide is present in the coating solution at a concentration of 0.1 M to 1 M.

In a twelfth embodiment of the first aspect, provided herein is the method of the ninth embodiment of the first aspect, wherein the coating solution further comprises $Fe(NO_3)_3$ at a concentration between 0.001 M to 0.1 M and $Fe_2O_3$ is co-deposited on the metal seeded textile substrate by the second ultrasonic irradiation deposition process.

In a thirteenth embodiment of the first aspect, provided herein is the method of the ninth embodiment of the first aspect, wherein the first ultrasonic irradiation deposition process comprises ultrasonic wave irradiation at a frequency of 20-25 kHz and a power of 730 to 770 W at between 40% and 60% ultrasound amplitude and the second ultrasonic irradiation deposition process comprises ultrasonic wave irradiation at a frequency of 20-25 kHz and a power of 730 to 770 W at between 30% and 50% ultrasound amplitude.

In a fourteenth embodiment of the first aspect, provided herein is the method of the thirteenth embodiment of the first aspect, wherein the first ultrasonic irradiation deposition process and the second ultrasonic irradiation deposition process are each independently less than 90 minutes.

In a fifteenth embodiment of the first aspect, provided herein is the method of the ninth embodiment of the first aspect, wherein the first metal precursor is $AgNO_3$ present in the seeding solution at a concentration of 0.020 M to 0.045 M; the first metal precursor reactant is ethylene glycol present in the seeding solution at a concentration of 60-80% v/v; the first ultrasonic irradiation deposition process comprises ultrasonic wave irradiation at a frequency of 20-22 kHz at a power of 730 to 770 W at between 40% and 60% ultrasound amplitude; the second metal precursor is $Zn(OAc)_2$ present in the coating solution at a concentration of 0.1 M to 0.6 M; the second metal precursor reactant is NaOH present in the coating solution at a concentration of 0.4 M to 0.6 M; and the second ultrasonic irradiation deposition process comprises ultrasonic wave irradiation at a frequency of 20-22 kHz at a power of 730 to 770 W at between 30% and 50% ultrasound amplitude.

In a sixteenth embodiment of the first aspect, provided herein is the method of the fifteenth embodiment of the first aspect, wherein the coating solution further comprises $Fe(NO_3)_3$ at a concentration between 0.01 M to 0.05 M and $Fe_2O_3$ is co-deposited on the metal seeded textile substrate by the second ultrasonic irradiation deposition process.

In a seventeenth embodiment of the first aspect, provided herein is the method of the sixteenth embodiment of the first aspect, wherein the metal coated textile substrate comprises substantially pure phase ZnO.

In an eighteenth embodiment of the first aspect, provided herein is the method of any one of the ninth embodiment of the first aspect to seventeenth embodiment of the first aspect, wherein the seeding solution comprises water and the coating solution comprises water.

In a second aspect, provided herein is a metal coated textile substrate prepared according to the method of the first aspect.

In a third aspect, provided herein is a metal coated textile substrate prepared according to the method of sixteenth embodiment of the first aspect.

Compared to conventional methods, the methods described herein are generally less time consuming and can be performed at ambient temperature and pressure. Advantageously, the methods described herein can be used for the in situ synthesis and durable incorporation of crystalline, inorganic materials (selective phase control for pure phase synthesis possible through "doping"; in this case a metal oxide system; zinc oxide (ZnO)), into textile substrates, such as cotton. The ZnO metal coated textile substrates prepared herein exhibit very high-performance UV-radiation blocking functional properties.

Those skilled in the art will appreciate that the disclosure described herein is susceptible to variations and modifications other than those specifically described.

Other aspects and advantages of the disclosure will be apparent to those skilled in the art from a review of the ensuing description.

BRIEF DESCRIPTION OF DRAWINGS

The above and other objects and features of the present disclosure will become apparent from the following description of the disclosure, when taken in conjunction with the accompanying drawings, in which.

DETAILED DESCRIPTION

Figure 1:
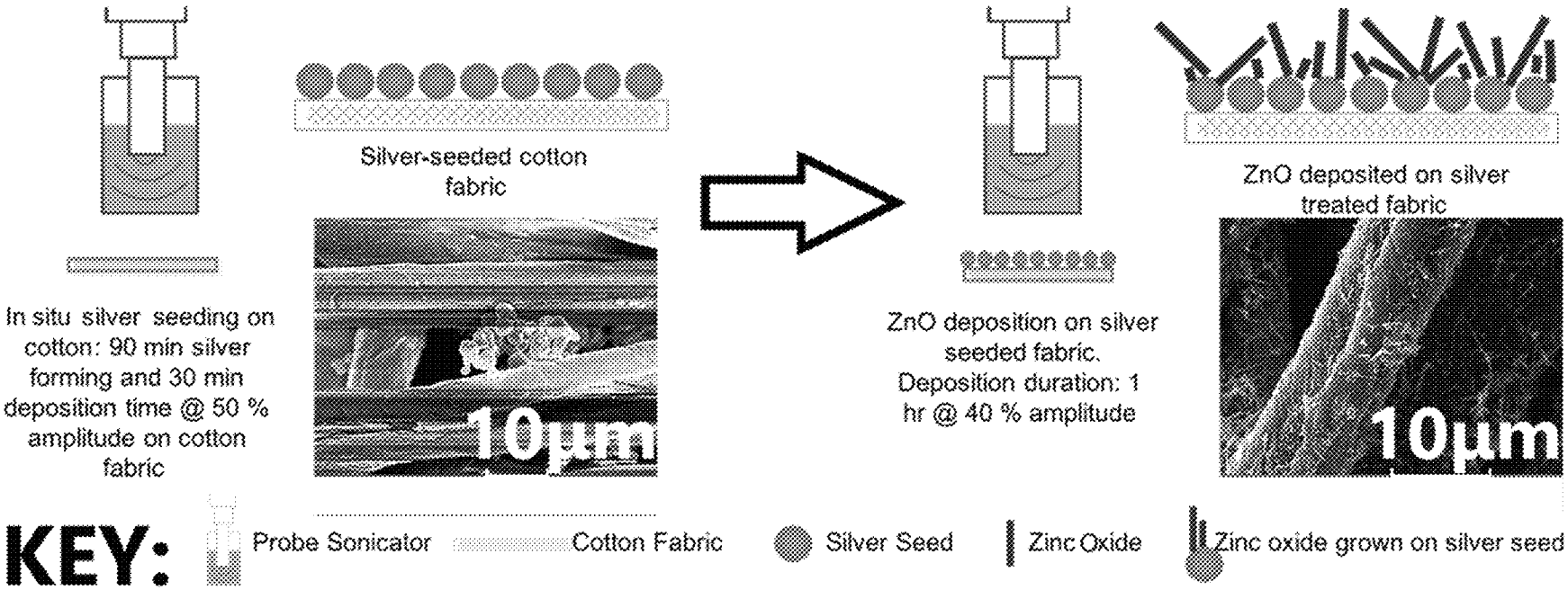
FIG. 1 depicts a schematic of the two-stage sonochemical deposition method, as illustrated by the seeded growth of zinc oxide, comprising silver seeding, followed by a second overlay coating of ZnO.

The present disclosure is not to be limited in scope by any of the specific embodiments described herein. The following embodiments are presented for exemplification only.

Throughout this application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

In this application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The term "phase purity", "crystalline purity", or the like when used in connection with a material refers to the percentage of the referenced crystalline phase relative to other crystalline phase(s) and/or an amorphous phase of the material in the referenced composition. Thus, for example, a composition comprising a ZnO hexagonal wurtzite phase having a crystalline purity of 95% would comprise 95 parts by weight of ZnO hexagonal wurtzite phase and 5 parts by weight of other crystalline/amorphous forms of ZnO.

The term "substantially pure" when used in connection with the phase of a material means the sample contains at least 60% by weight of the crystalline phase. In certain embodiments, the sample contains at least 70% by weight of the crystalline phase; at least 75% by weight of the crystalline phase; at least 80% by weight of the crystalline phase; at least 85% by weight of the crystalline phase; at least 90% by weight of the crystalline phase; at least 95% by weight of the crystalline phase; or at least 98% by weight of the crystalline phase.

As used herein, "ultrasound" or "ultrasonic radiation" refers to mechanical (including acoustic or other types of pressure) waves in a medium in the general frequency range from about 20 kHz to about 4 GHz or greater. In certain embodiments, the ultrasound is in the frequency range of about 20 kHz.

Provided herein is a method for preparing a metal coated textile substrate comprising: depositing a first plurality of metal nanoparticles on a textile substrate by a first ultrasonic irradiation deposition process thereby forming a metal seeded textile substrate; and depositing a second plurality of metal nanoparticles on the metal seeded textile substrate by a second ultrasonic irradiation deposition process thereby forming the metal coated textile substrate.

The textile substrate may be synthetic, semi-synthetic, or natural. Natural organic fibers, including biodegradable materials, cellulosic and/or protein fibers. The textile substrate may be woven or non-woven. The textile substrate may also be in the form of a fabric, a fiber, a filament, a film, a garment, or a chopped or flocculated fiber.

Natural organic textile substrates may be of any plant or animal origin, and include, for example, those fibrous materials derived from natural products containing celluloses, such as any one or a combination of wood, bamboo, cotton, banana, piña, hemp ramie, linen, coconut palm, soya, milk, hoya, bagasse, kanaf, retting, mudrar, silk, wool, cashmere, alpaca, angora wool, mohair, shearling, vicuña, shahtoosh, and the like.

Semi-synthetic textile substrates may include, for example, any one or a combination of viscose, cuprammonium, rayon, polynosic, lyocell, cellulose acetate, and the like.

Synthetic organic textile substrates acrylic, Kevlar, modacrylic, nomex, spandex, nylon, polyester, acrylic, rayon, acetate and the like In certain embodiments, the textile substrate may be a blended textile substrate, such as polyethylene terephthalate (PET)/cotton blend.

Exemplary textile fabric substrates onto which metals may be applied include bandages or wound dressings, fabrics for forming clothing or bed sheets, and the like.

The textile substrate can optionally be pre-treated (e.g., to clean and/or prepare the textile substrate surface) prior to subjecting it to the methods described herein. In such embodiments, the textile substrate can be sequentially washed an aqueous solution of a non-ionic surfactant, such as Triton X-100 (polyethylene glycol p-(1,1,3,3-tetramethylbutyl)-phenyl ether), rinsed with water, rinsed volatile organic solvent, such as acetone, and dried.

Suitable non-ionic surfactants that can be used in the optional pre-treatment step, include, but are not limited to dodecyl dimethylamine oxide, coco diethanol-amide alcohol ethoxylates, linear primary alcohol polyethoxylate, alkylphenol ethoxylates, alcohol ethoxylates, EO/PO polyol block polymers, polyethylene glycol esters, and fatty acid alkanolamides.

Suitable volatile organic solvents that can be used in the optional pre-treatment step, include, but are not limited to ethanol, isopropanol, ethyl acetate, and tetrahydrofuran.

Without wishing to be bound by theory, it is believed that sonochemical deposition of the second plurality of metal nanoparticles on textile substrates can be improved by surface modification with a first plurality of metal nanoparticles. Surface modifications created by deposition of the first plurality of metal nanoparticles can help in achieving a larger surface area and increase the number of reaction sites, which in turn provide stronger anchoring and/or adhesive effect between the textile substrate and the second plurality of metal nanoparticles. While the methods described herein are capable of preparing highly crystalline powders on their own (and with minimal doping, highly pure, single phase crystalline powders), for reliable and durable incorporation within textiles, the sonochemical deposition of the first plurality of metal nanoparticles allows for a straightforward and environmentally friendly method for durable incorporation of phase controlled metal coatings on textiles.

First plurality of metal nanoparticles suitable for the methods described herein, include, but are not limited to Ag, Au, Pt, Pd, Ni, Cu, CuO, $Cu_2O$, CuS, $Cu_2S$, ZnS, $Sn_2S$, $TiS_2$, PbO, $Pb_2O$, PbS, $Ag_2S$, $TiO_2$, $SnO_2$, ZnO, and $Al_2O_3$. In certain embodiments, the first plurality of metal nanoparticles is selected from the group consisting of Ag and $Al_2O_3$.

The deposition of the first plurality of metal nanoparticles onto the textile substrate is affected by the first ultrasonic irradiation deposition process. The first ultrasonic irradiation deposition process can comprise ultrasonic wave irradiation in the range of 20 kHz to 100 kHz, 20 kHz to 50 kHz, 20 kHz to 30 kHz, 20 kHz to 25 kHz, or 20 kHz to 22 kHz. The first ultrasonic irradiation deposition process can comprise ultrasonic wave irradiation having a power of 700 to 800 W, 725 to 775 W, 730 to 770 W, or 740 to 760 W. The first ultrasonic irradiation deposition process can comprise ultrasonic wave irradiation with an amplitude of 10% and 60%, 20% to 70%, 20% to 60%, 30% to 60%, 40% to 60%, 45% to 55%, or 48% to 52%.

In certain embodiments, the second ultrasonic irradiation deposition process comprises ultrasonic wave irradiation for up to 3 hours. In certain embodiments, the second ultrasonic irradiation deposition process comprises ultrasonic wave irradiation for up to 3 hours, 2 hours, 1 hours, 45 minutes, or 30 minutes. In certain embodiments, the second ultrasonic irradiation deposition process comprises ultrasonic wave irradiation for 15 minutes to 60 minutes or 20 minutes to 40 minutes.

In certain embodiments, the first ultrasonic irradiation deposition process comprises ultrasonic wave irradiation at a frequency at least 20 kHz and a power of 700 to 800 W at between 10% and 60% ultrasound amplitude. In certain embodiments, the first ultrasonic irradiation deposition process comprises ultrasonic wave irradiation at a frequency of 20 kHz to 25 kHz and a power of 730 to 770 W at between 45% to 55% ultrasound amplitude; or 20 kHz to 22 kHz and a power of 740 to 760 W at between 48% to 52% ultrasound amplitude. In certain embodiments, the first ultrasonic irradiation deposition process comprises ultrasonic wave irradiation at a frequency of 20 kHz and a power of 750 W at 50% ultrasound amplitude.

Deposition of the first plurality of metal nanoparticles on to the textile substrate yields a metal seeded textile substrate. FIG. 2A depicts a SEM image of a silver metal seeded cotton textile substrate, which clearly shows deposition of the silver nanoparticles onto the cotton textile substrate.

The metal seeded textile substrate can then be brought into contact with a second plurality of metal nanoparticles and subjected to a second ultrasonic irradiation deposition process thereby forming the metal coated textile substrate.

Second plurality of metal nanoparticles suitable for the methods described herein, include, but are not limited to one or more oxides of zinc, vanadium, tungsten, tin, titanium, germanium, cadmium, copper, indium, iron, thallium and bismuth. In certain embodiments, the second plurality of metal nanoparticles is selected from the group consisting of $VO_2$, $WO_3$, ZnO, CuO, $Cu_2O$, $TiO_2$, $SnO_2$, $Fe_2O_3$, and $Fe_3O_4$.

Advantageously, when a metal dopant is co-deposited with the second plurality of metal nanoparticles on the metal seeded textile substrate by the second ultrasonic irradiation deposition process that phase control can be achieved over the deposited second plurality of metal nanoparticles. More particularly, it has been surprisingly found that when the second ultrasonic irradiation deposition process is conducted in the presence of a metal dopant, the deposited second plurality of metal nanoparticles can be substantially phase pure. For example, FIG. 4B shows that when $Fe_2O_3$ is co-deposited in the second ultrasonic irradiation deposition process that substantially pure ZnO wurtzite phase is deposited onto the Ag metal seeded textile substrate. In certain embodiments, the metal dopant comprises a metal selected from the group consisting of aluminum, titanium, iron, tin, indium, gallium, tungsten, antimony, niobium, tantalum, bismuth, cadmium, rhenium, cerium, vanadium, chromium, zirconium, nickel, and germanium. In certain embodiments, the metal dopant is selected from the group consisting of titania, alumina, geranium, a stannous oxide, an indium oxide, a gallium oxide, a tungsten oxide, an antimony oxide, a niobium oxide, a tantalum oxide, a bismuth oxide, a cadmium oxide, a rhenium oxide, a cerium oxide, a vanadium oxide, a chromium oxide, a zirconium oxide, and a nickel oxide. In certain embodiments, the metal dopant is $Fe_2O_3$ and $Fe_3O_4$.

The deposition of the second plurality of metal nanoparticles onto the textile substrate is affected by the second ultrasonic irradiation deposition process. The second ultrasonic irradiation deposition process can comprise ultrasonic radiation can be in the range of 20 kHz to 100 kHz, 20 kHz to 50 kHz, 20 kHz to 30 kHz, 20 kHz to 25 kHz, or 20 kHz to 22 kHz. The first ultrasonic irradiation deposition process can comprise ultrasonic radiation having a power of 700 to 800 W, 725 to 775 W, 730 to 770 W, or 740 to 760 W. The second ultrasonic irradiation deposition process can comprise ultrasonic radiation with an amplitude of 20% to 70%, 20% to 60%, 30% to 60%, 30% to 50%, 35% to 45%, or 48% to 52%.

In certain embodiments, the second ultrasonic irradiation deposition process comprises ultrasonic wave irradiation for up to 5 hours. In certain embodiments, the second ultrasonic irradiation deposition process comprises ultrasonic wave irradiation for up to 4 hours, 3 hours, 2 hours, 1.5 hours, 1.25 hours, or 1 hour. In certain embodiments, the second ultrasonic irradiation deposition process comprises ultrasonic wave irradiation for 0.5 hours to 1.5 hours, 0.75 hours to 1.25 hours.

In certain embodiments, the second ultrasonic irradiation deposition process comprises ultrasonic wave irradiation at a frequency at least 20 kHz and a power of 700 to 800 W at between 10% and 60% ultrasound amplitude. In certain embodiments, the second ultrasonic irradiation deposition process comprises ultrasonic wave irradiation at a frequency of 20 kHz to 25 kHz and a power of 730 to 770 W at between 35% to 45% ultrasound amplitude; or 20 kHz to 22 kHz and a power of 740 to 760 W at between 38% to 42% ultrasound amplitude.

FIG. 1 shows an overview of an exemplary process for preparing a zinc (II) oxide coated cotton fabric textile according to certain embodiments described herein, wherein silver is the first plurality of metal nanoparticles and zinc (II) oxide is the second plurality of metal nanoparticles. FIG. 2A shows SEM images of the cotton textile substrate, silver seeded metal seeded cotton textile substrate and the zinc (II) oxide metal coated cotton textile substrate. The deposited zinc (II) oxide nanoparticles can be between 0.5 and 5 μm in diameter (i.e., along their longest dimension).

Each of the first plurality of metal nanoparticles and the second plurality of metal nanoparticles can independently be used directly in the methods described herein or can be prepared in situ under the conditions for the first ultrasonic irradiation deposition process and/or second ultrasonic irradiation deposition process, respectively.

In instances in which both the first plurality of metal nanoparticles and the second plurality of metal nanoparticles are both prepared in situ, the method for preparing the metal coated textile substrate can comprise: providing an seeding solution comprising a first metal precursor and a first metal precursor reactant; irradiating the seeding solution by a first ultrasonic irradiation reaction process thereby forming a first plurality of metal nanoparticles; depositing the first plurality of metal nanoparticles on a textile substrate by a first ultrasonic irradiation deposition process thereby forming a metal seeded textile substrate; providing an coating solution comprising a second metal precursor and a second metal precursor reactant; irradiating the coating solution by a second ultrasonic irradiation reaction process thereby forming a second plurality of metal nanoparticles; and depositing the second plurality of metal nanoparticles on the metal seeded textile substrate by a second ultrasonic irradiation deposition process thereby forming the metal coated textile substrate.

The seeding solution may comprise a solvent selected from the group consisting of water, methanol, ethanol, 1-propanol, 2-propanol, ethylene glycol, acetic acid, ethyl acetate, 1,4-dioxane, tetrahydrofuran, dimethoxyethane, hexane, cyclohexane, heptane, xylene, dichloromethane, chloroform, and any combination thereof. In certain embodiments, the seeding solution comprises a solvent selected from the group consisting of water, methanol, ethanol, 1-propanol, 2-propanol, ethylene glycol, 1,4-dioxane, tetrahydrofuran, dimethoxyethane, acetic acid, ethyl acetate, and any combination thereof. In certain embodiments, the seeding solution comprises a solvent selected from the group consisting of water, methanol, ethanol, 1-propanol, 2-propanol, and any combination thereof.

In certain embodiments, the seeding solution comprises water. In such instances, the seeding solution may also be referred to as an aqueous seeding solution.

Any method for in situ preparation of the first plurality of metal nanoparticles known in the art can be used for the preparation of the first plurality of metal nanoparticles, such as by reduction or anion exchange [e.g., with water (hydrolysis) or with sulfide] of the first metal precursor.

In certain embodiments, the first metal precursor is substantially soluble in the seeding solution and upon subjection to the first ultrasonic irradiation process produces the first plurality of metal nanoparticles in which at least a portion of the first plurality of metal nanoparticles precipitate from the seeding solution and are deposited on to the textile substrate during the first ultrasonic irradiation deposition process. The selection of the first metal precursor and the determination of its concentration in the seeding solution is well within the skill of someone of ordinary skill in the art.

In certain embodiments, the second metal precursor is substantially soluble in the coating solution and upon subjection to the second ultrasonic irradiation process produces the first plurality of metal nanoparticles in which at least a portion of the first plurality of metal nanoparticles precipitate from the seeding solution and are deposited on to the textile substrate during the first ultrasonic irradiation deposition process. The selection of the second metal precursor and the determination of its concentration in the coating solution is well within the skill of someone of ordinary skill in the art.

In certain embodiments, the first metal precursor is a silver (I) salt and the first metal precursor reactant is reductant, such as $NaBH_4$, polyethylene glycol (PEG) or ethylene glycol. Exemplary silver (I) salts comprise an anion selected from the group consisting of $O^{2-}$, $OH^-$, $S^{2-}$, $Br^-$, $Cl^-$, $I^-$, $NO_3^-$, $CO_3^{2-}$, $ClO_3^-$, $ClO_4^-$, $SO_4^{2-}$, $PO_4^{3-}$, $BF_4^-$, acetate, acetylacetonate, lactate, benzoate, and tosylate. In certain embodiments, the silver (I) salt is $AgNO_3$ or Ag(acetate).

The silver (I) salt can be present in the seeding solution at a concentration between 0.005 M to 0.10 M. In certain embodiments, the silver (I) salt can be present in the seeding solution at a concentration between 0.005 M to 0.50 M, 0.010 M to 0.50 M, 0.010 M to 0.045 M, 0.0115 M to 0.043 M, 0.011 M to 0.0225 M, or 0.0225 M to 0.043 M.

The PEG or ethylene glycol can be present in the seeding solution at a concentration between 10-90% v/v. In certain embodiments, the reductant can be present in the seeding solution at a concentration between 20-90% v/v, 20-80% v/v, 30-80% v/v, 40-80% v/v, 50-80% v/v, 50-70% v/v, 60-70% v/v, or 60-65% v/v.

In certain embodiments, the seeding solution comprises $AgNO_3$ at a concentration between 0.0115 M to 0.043 M, 0.011 M to 0.0225 M, or 0.0225 M to 0.043 M; and ethylene glycol at a concentration of 50-70% v/v, 60-70% v/v, or 60-65% v/v.

In instances in which the first plurality of metal nanoparticles is prepared by reaction with a reductant, a stabilizing agent can optionally be added to the reaction of the first metal precursor and the first metal precursor reactant. The stabilizing agent can be any metal nanoparticle stabilizing agent known in the art. Exemplary stabilizing agents include, but are not limited to polyvinylpyrrolidone (PVP) or vinylpyrrolidone. The stabilizing agent can be present in the seeding solution at a concentration between 0.0010 M to 0.78 M. In certain embodiments, the concentration of PVP in the seeding solution is between 0.0010 M to 0.007 M or 0.0016 M to 0.0065 M. In certain embodiments, the concentration of vinylpyrrolidone in the seeding solution is between 0.30 M to 0.78 M.

In instances in which the first plurality of metal nanoparticles is prepared by reaction with a reductant, sodium chloride can optionally be added to the seeding solution. Sodium chloride can be present in the seeding solution at a concentration between 0.015 M to 0.060 M.

In certain embodiments, the first metal precursor is a silver (I) salt and the first metal precursor is citrate salt and a thiosulfate salt. Exemplary silver (I) salts comprise an anion selected from the group consisting of $O^{2-}$, $OH^-$, $S^{2-}$, $Br^-$, $Cl^-$, $I^-$, $NO_3^-$, $CO_3^{2-}$, $ClO_3^-$, $ClO_4^-$, $SO_4^{2-}$, $PO_4^{3-}$, $BF_4^-$, acetate, acetylacetonate, lactate, benzoate, and tosylate. In certain embodiments, the first metal precursor is a silver (I) salt is $AgNO_3$. The citrate salt and the thiosulfate salt can independently be salts of $Li^+$, $Na^+$, $K^-$, $Mg^+$, $Ca^+$, $NH_4^+$, or a combination thereof. In certain embodiments, the citrate salt and the thiosulfate salt are sodium citrate and sodium thiosulfate.

In certain embodiments, the first metal precursor is an aluminum (III) salt and the first metal precursor is an alkali metal hydroxide. Exemplary aluminum (III) salts comprise one or more anions selected from the group consisting of $S^{2-}$, $OH^-$, $Br^-$, $Cl^-$, $F^-$, $I^-$, $NO_3^-$, $CO_3^{2-}$, $ClO_3^-$, $ClO_4^-$, $SO_4^{2-}$, $PO_4^{3-}$, hexafluoroaluminate, acetate, acetylacetonate, lactate, benzoate, oxalate, and $OR^-$, wherein R is a $C_1$-$C_6$ alkyl. In certain embodiments, the aluminum (III) salt is $AlCl_3$, $Al(NO_3)_3$, $Al(OH)_3$, Al(acetylacetonate)$_3$, $Na_3AlF_6$, $Al(OiPr)_3$, or $Al_2S_3$. In certain embodiments, the aluminum (III) salt is $AlCl_3$ or $Al(NO_3)_3$. The alkali metal hydroxide can be LiOH, NaOH, or KOH. In certain embodiments, the aluminum (III) salt is present in the seeding solution at a concentration between 0.2 M and 0.4 M. In certain embodiments, the alkali metal hydroxide is present in the seeding solution at a concentration between 0.2 M and 0.8 M, 0.2 M and 0.6 M, 0.3 M and 0.8 M, 0.4 M and 0.8 M, 0.5 M and 0.8 M, 0.5 M and 0.7 M, or 0.55 M to 0.65 M. In certain embodiments, the aluminum (III) salt is $AlCl_3$ and the alkali metal hydroxide is NaOH.

In certain embodiments, the first metal precursor is a trialkylaluminum, such as trimethyl aluminum, triethylaluminum, and the like. In certain embodiments, the trialkylaluminum is $Al(C_1$-$C_6$alkyl$)_3$. In instances in which the first metal precursor is a trialkylaluminum, the second metal precursor reactant can be water.

In any of the embodiments described herein or combination of embodiments described herein, the seeding solution may be an aqueous coating solution.

The seeding solution comprising the first metal precursor and the first metal precursor reactant can be irradiated using the first ultrasonic irradiation reaction process thereby forming the first plurality of metal nanoparticles. Advantageously, the first ultrasonic irradiation reaction process can catalyze the reaction the first metal precursor and the first metal precursor reactant thereby forming the first plurality of metal nanoparticles under ambient conditions (e.g., without the application of an external heat source).

The first ultrasonic irradiation reaction process can comprise ultrasonic wave irradiation in the range of 20 kHz to 100 kHz, 20 kHz to 50 kHz, 20 kHz to 30 kHz, 20 kHz to 25 kHz, or 20 kHz to 22 kHz. The first ultrasonic irradiation reaction process can comprise ultrasonic wave irradiation having a power of 700 to 800 W, 725 to 775 W, 730 to 770 W, or 740 to 760 W. The first ultrasonic irradiation reaction process can comprise ultrasonic wave irradiation with an amplitude of 10% and 60%, 20% to 70%, 20% to 60%, 30% to 60%, 40% to 60%, 45% to 55%, or 48% to 52%.

In certain embodiments, first ultrasonic irradiation reaction process comprises ultrasonic wave irradiation at a frequency at least 20 kHz and a power of 700 to 800 W at between 10% and 60% ultrasound amplitude. In certain embodiments, the first ultrasonic irradiation reaction process comprises ultrasonic wave irradiation at a frequency of 20 kHz to 25 kHz and a power of 730 to 770 W at between 45% to 55% ultrasound amplitude; or 20 kHz to 22 kHz and a power of 740 to 760 W at between 48% to 52% ultrasound amplitude. In certain embodiments, the first ultrasonic irradiation reaction process comprises ultrasonic wave irradiation at a frequency of 20 kHz and a power of 750 W at 50% ultrasound amplitude.

The methods described herein can optionally be simplified by using the same ultrasonic conditions for the first ultrasonic irradiation reaction process conditions and the first ultrasonic irradiation deposition process conditions.

The first plurality of metal nanoparticles can then be deposited on the textile substrate using the first ultrasonic irradiation deposition process as described herein thereby forming the metal seeded textile substrate.

The second plurality of metal nanoparticles can be used directly or be prepared using any method for in situ preparation of known in the art can be used for the preparation of the second plurality of metal nanoparticles, such as by reduction or anion exchange [e.g., with water (hydrolysis)] of the first metal precursor.

The coating solution may comprise a solvent selected from the group consisting of water, methanol, ethanol, 1-propanol, 2-propanol, ethylene glycol, acetic acid, ethyl acetate, 1,4-dioxane, tetrahydrofuran, dimethoxyethane, hexane, cyclohexane, heptane, xylene, dichloromethane, chloroform, and any combination thereof. In certain embodiments, the coating solution comprises a solvent selected from the group consisting of water, methanol, ethanol, 1-propanol, 2-propanol, ethylene glycol, 1,4-dioxane, tetrahydrofuran, dimethoxyethane, acetic acid, ethyl acetate, and any combination thereof. In certain embodiments, the coating solution comprises a solvent selected from the group consisting of water, methanol, ethanol, 1-propanol, 2-propanol, and any combination thereof.

In certain embodiments, the coating solution comprises water. In such instances, the coating solution may also be referred to as an aqueous coating solution.

In certain embodiments, the second metal precursor is a zinc (II) salt and the second metal precursor reactant is an alkali metal hydroxide. Exemplary zinc (II) salts comprise one or more anions selected from the group consisting of $OH^-$, $Br^-$, $Cl^-$, $I^-$, $NO_3^-$, $CO_3^{2-}$, $ClO_3^-$, $ClO_4^-$, $SO_4^{2-}$, $PO_4^{3"}$, $BF_4^-$, acetate, acetylacetonate, glycolate, lactate, benzoate, citrate, and tosylate. In certain embodiments, the zinc (II) salt is $Zn(OAc)_2$ or $Zn(NO_3)_2$.

The zinc (II) salt can be present in the coating solution at a concentration between 0.02 M to 0.2 M. In certain embodiments, the zinc (II) salt can be present in the coating solution at a concentration between 0.02 M to 0.17 M, 0.02 M to 0.15 M, 0.03 M to 0.1 M, 0.04 M to 0.1 M, or 0.05 M to 0.1 M.

In certain embodiments, the first metal precursor is a dialkylzinc, such as dimethyl zinc, diethylzinc, and the like. In certain embodiments, the dialkylzinc is $Zn(C_1\text{-}C_6alkyl)_2$. In instances in which the first metal precursor is a dialkylzinc, the second metal precursor reactant can be water.

The alkali metal hydroxide can be present in the coating solution at a concentration between 0.05 M to 1 M. In certain embodiments, the alkali metal hydroxide can be present in the coating solution at a concentration between 0.05 M to 0.9 M, 0.05 M to 0.8 M, 0.0.05 M to 0.7 M, 0.05 M to 0.6 M, 0.05 M to 0.5 M, 0.1 M to 0.5 M, 0.2 M to 0.5 M, 0.2 M to 0.4 M, or 0.25 M to 0.35 M.

In certain embodiments, the coating solution comprises $Zn(OAc)_2$ at a concentration between 0.04 M to 0.1 M or 0.05 M to 0.1 M; and NaOH at a concentration of 0.4 M to 0.6 M or 0.47 M to 0.53 M.

In certain embodiments, the coating solution comprising a zinc (II) salt and an alkali metal hydroxide can further comprise a pH adjusting agent. The pH adjusting agent can be any pH adjusting agent known in the art. An exemplary pH adjusting agent includes, but is not limited to ammonia. Ammonia can be used to adjust the pH of the coating solution in the range of pH 11 and 13. In certain embodiments, the coating solution comprising a zinc (II) salt and an alkali metal hydroxide further comprises aqueous ammonia (1-35% m/v). In certain embodiments, the aqueous ammonia has a concentration between 25-30% m/v.

In certain embodiments, the second metal precursor is a titanium salt selected from the group consisting of $TiX_4$, wherein X is Cl, Br, or I; $Ti(OR)_4$, wherein R is $C_1$-$C_6$ alkyl; $Ti(NR_2)_4$, wherein R is $C_1$-$C_6$ alkyl; and a titanium sulfide and the second metal precursor reactant is water. In certain embodiments, the $Ti(OR)_4$ is $Ti(OEt)_4$ or $Ti(OiPr)_4$.

In certain embodiments, the coating solution comprises $Ti(OiPr)_4$ at a concentration between 1 M to 1.5 M in water In certain embodiments, the second metal precursor is a copper (II) salt and the second metal precursor reactant is an alkali metal hydroxide. Exemplary copper (II) salts comprise one or more anions selected from the group consisting of $O^{2-}$, $S^{2-}$, $Br^-$, $Cl^-$, $I^-$, $NO_3^-$, $CO_3^{2-}$, $ClO_3^-$, $ClO_4^-$, $SO_4^{2-}$, $PO_4^{3-}$, $BF_4^-$, acetate, lactate, benzoate, citrate, and tosylate. In certain embodiments, the copper (II) salt is CuO, $Cu_2O$, CuS, $Cu_2S$, or $Cu(NO_3)_2$. In certain embodiments, the copper (II) salt is $Cu(NO_3)_2$.

The copper (II) salt can be present in the coating solution at a concentration between 0.02 M to 0.08 M, 0.03 M to 0.08 M, 0.04 M to 0.08 M, 0.05 M to 0.08 M, 0.05 M to 0.07 M, or 0.055 M to 0.065 M.

In certain embodiments, the coating solution comprising copper (II) salt and an alkali metal hydroxide can further comprise a surfactant. In certain embodiments, the surfactant is a non-ionic surfactant. suitable nonionic surfactants include alkanolamides, amine oxides, block polymers, ethoxylated primary and secondary alcohols, ethoxylated alkylphenols, ethoxylated fatty esters, sorbitan derivatives, glycerol esters, propoxylated and ethoxylated fatty acids, alcohols, and alkyl phenols, alkyl glucoside glycol esters, polymeric polysaccharides, sulfates and sulfonates of ethoxylated alkylphenols, and polymeric surfactants. Suitable anionic surfactants include ethoxylated amines and/or amides, sulfosuccinates and derivatives, sulfates of ethoxylated alcohols, sulfates of alcohols, sulfonates and sulfonic acid derivatives, phosphate esters, and polymeric surfactants. Exemplary surfactants include, but are not limited to monoethanolamine (MEA), diethanolamine (DEA), and triethanolamine (TEA). The surfactant can control the morphology of the deposited copper coating and may also act as a pH buffering agent. In certain embodiments, the coating solution comprising a copper (II) salt and an alkali metal hydroxide further comprises DEA (20-40% v/v). In certain embodiments, the concentration of DEA in the coating solution is between 30-37% v/v, 32-37% v/v, or 32-35% v/v.

In certain embodiments, the coating solution further comprises a metal dopant, which is co-deposited on the metal seeded textile substrate by the second ultrasonic irradiation deposition process together the second plurality of metal nanoparticles. Co-deposition of the metal dopant can modify the properties of the deposited second plurality of metal nanoparticles and the resulting metal coated textile substrate.

In certain embodiments, co-deposition of the metal dopant can modify the crystalline phase of the deposited second plurality of metal nanoparticles, e.g., result in the deposition of substantially pure crystalline phase of the second plurality of metal nanoparticles. As demonstrated in FIG. 4B, when a metal dopant is added to the coating solution at a concentration between 0.01 to 0.05 M the crystalline phase purity of the deposited ZnO can be modified. At certain concentrations of the metal dopant, the deposited ZnO is substantially pure crystalline phase.

Figure 5:
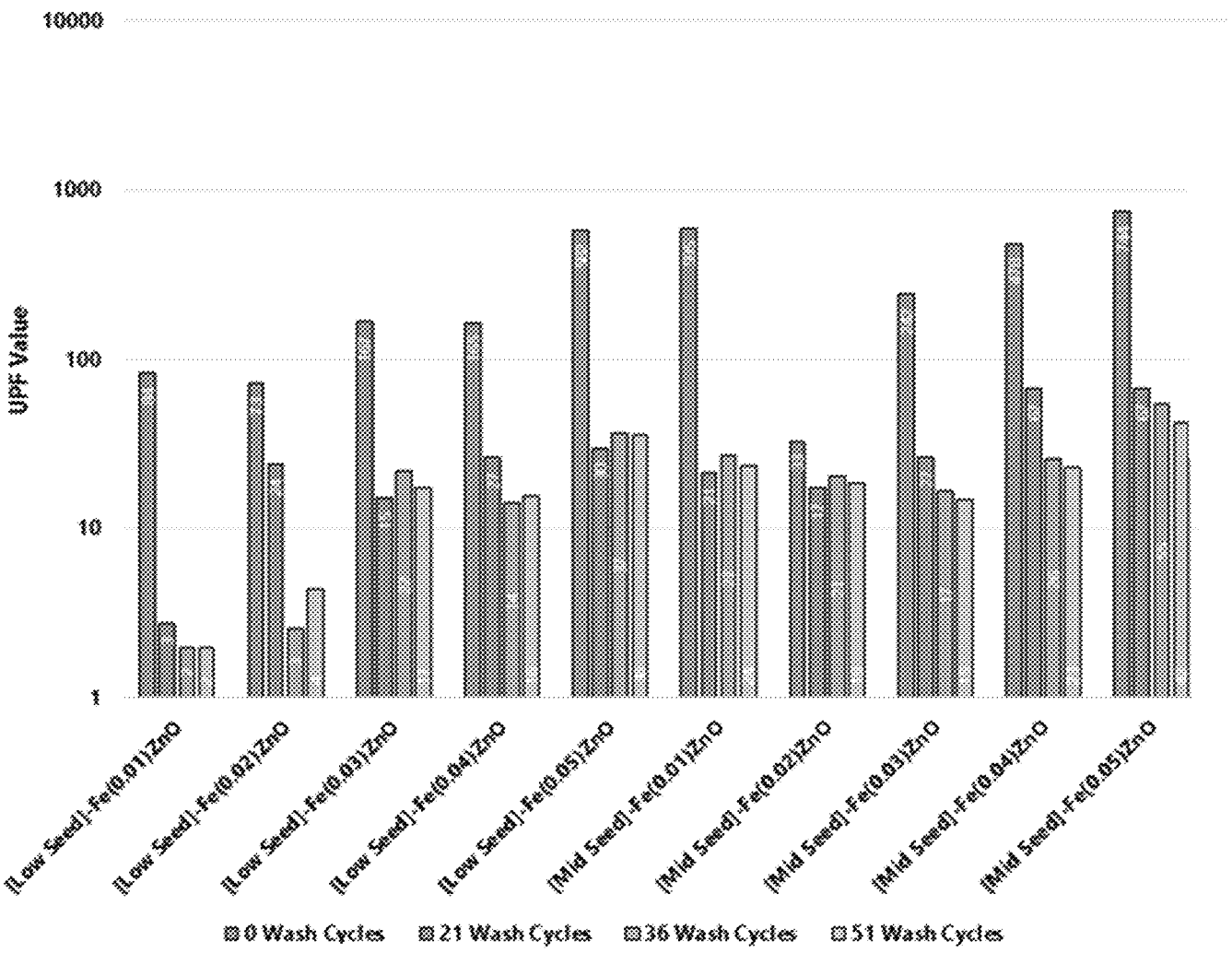
FIG. 5 depicts a table showing laundering durability data as a function of UV protection (UPF) values of ZnO coated textiles prepared in accordance with the methods described herein with various concentrations of Ag (first plurality of metal nanoparticles), ZnO (second plurality of metal nanoparticles), and $Fe_2O_3$ (metal dopant) after 0, 21, 36, and 51 accelerated washes prepared from aqueous seeding solutions comprising low seed (11.25 mM), mid seed (21.5 mM), and hi seed (43 mM) concentrations of $AgNO_3$; and aqueous coating solutions comprising 0.3 M $Zn(OAc)_2$ and between 0.01 M to 0.05 M $Fe(NO_3)_3$. Data for each entry is shown from left to right in order of 0 wash cycles, 21 wash cycles, 36 wash cycles, and 51 wash cycles from left to right.
Figure 5:
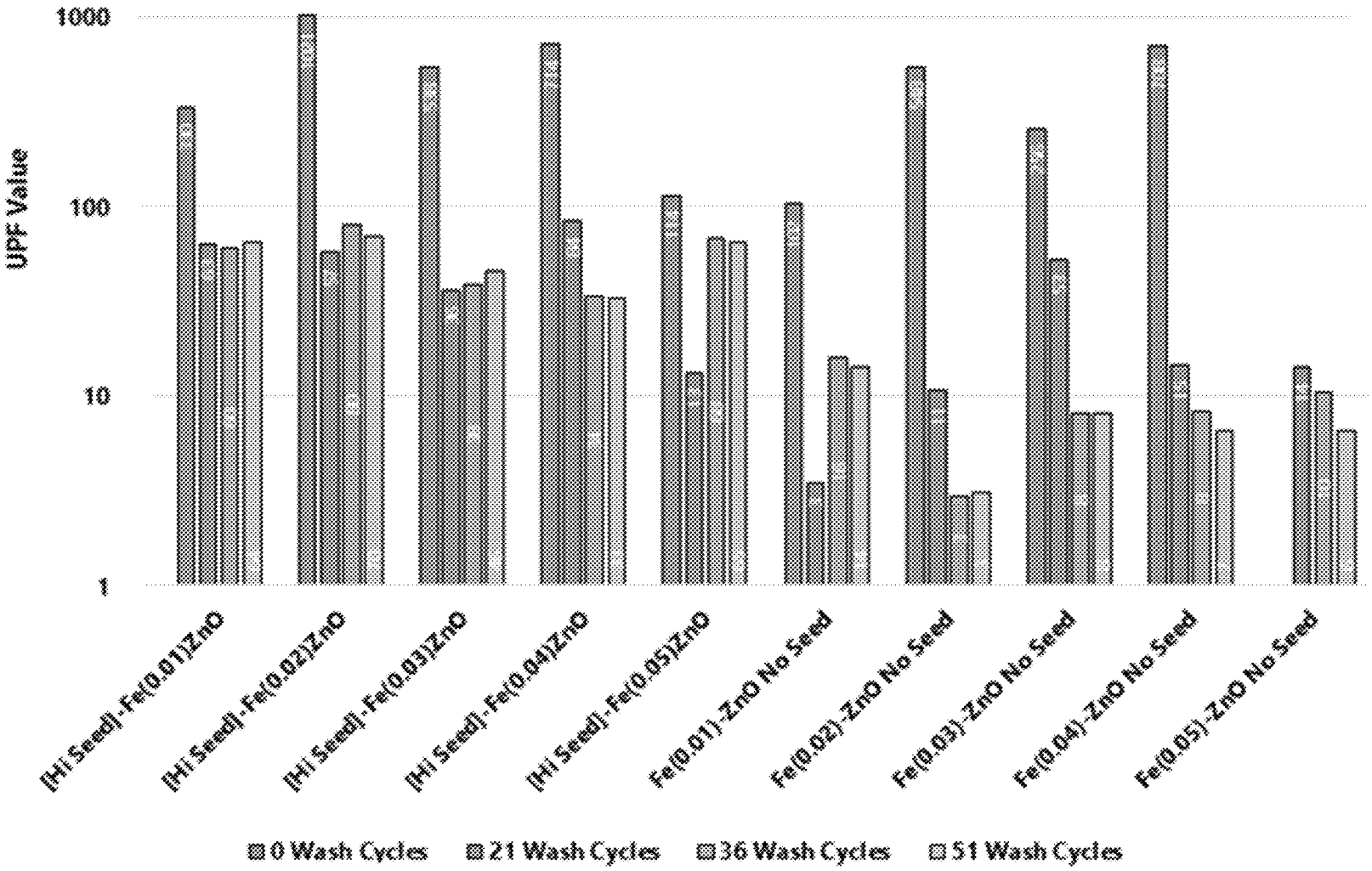
Figure 6:
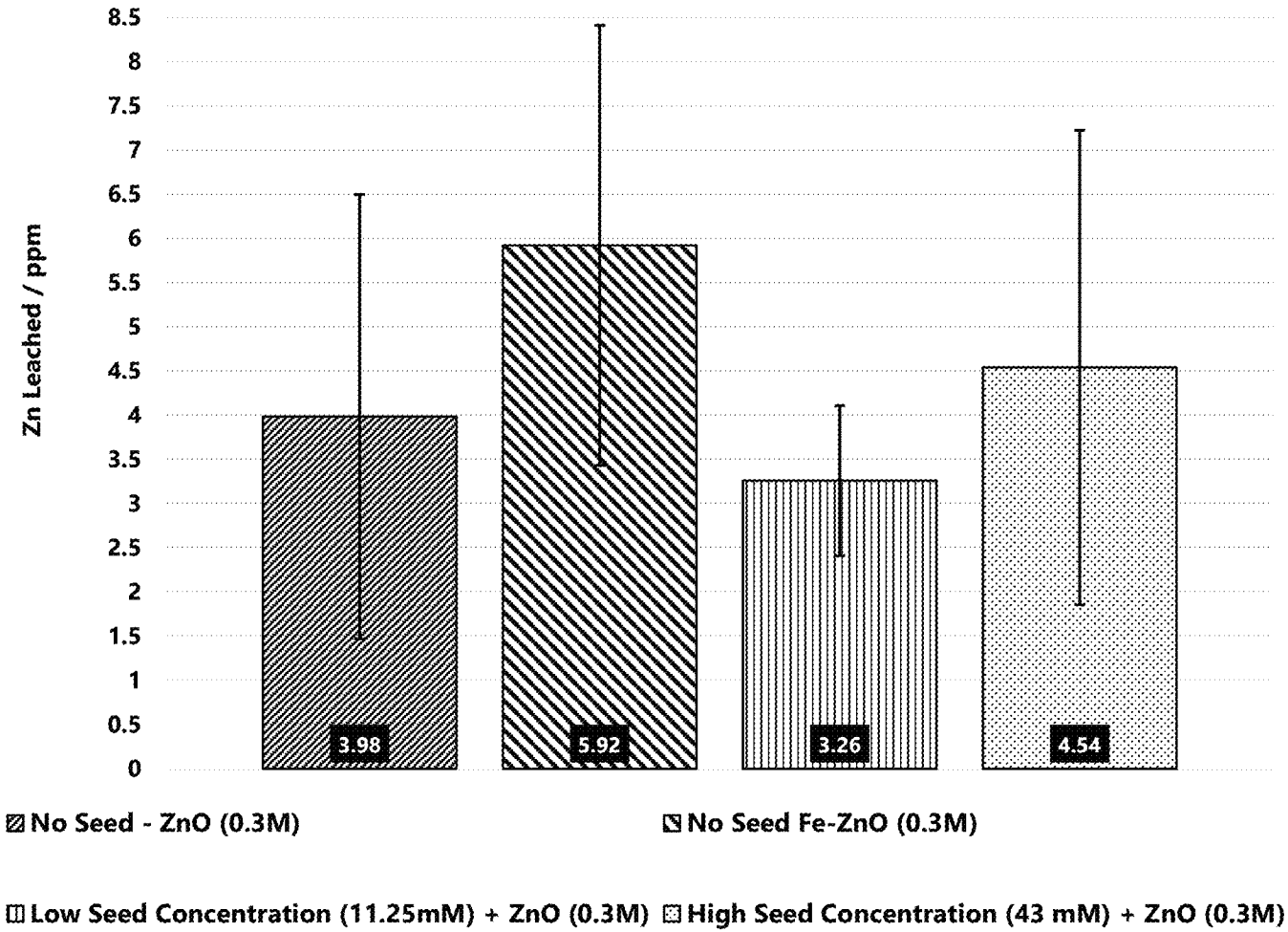
FIG. 6 depicts a table showing inductively coupled plasma atomic emission spectroscopy (ICP-OES) data obtained from zinc leached from ZnO coated textiles prepared in accordance with the methods described herein with various concentrations of Ag (first plurality of metal nanoparticles), ZnO (second plurality of metal nanoparticles), and $Fe_2O_3$ (metal dopant) and comparative examples prepared without a seed layer (first plurality of metal nanoparticles) prepared from aqueous seeding solutions comprising low seed (11.25 mM) and high seed (43 mM) concentrations of $AgNO_3$; and aqueous coating solutions comprising 0.3 M $Zn(OAc)_2$ and between 0.01 M to 0.05 M $Fe(NO_3)_3$.

In certain embodiments, co-deposition of the metal dopant can modify UPF of the metal coated textile over repeated wash cycles. As demonstrated in FIG. 5, when a metal dopant is added to the coating solution at a concentration between 0.01 to 0.05 M, the resulting UPF of the metal coated textile substrate can be modified. At certain concentrations of the metal dopant, the UPF of the metal coated textile can advantageously be maintained above 50 for over 51 accelerated washes.

In certain embodiments, the coating solution further comprises a metal dopant selected from the group consisting of iron (II), iron (III), or a combination thereof.

In certain embodiments, the coating solution further comprises an iron (III) salt. Exemplary iron (III) salts comprise one or more anions selected from the group consisting of $OH^-$, $S^{2-}$, Br, $Cl^-$, $F^-$, $I^-$, $NO_3^-$, $CO_3^{2-}$, $ClO_3^-$, $ClO_4^-$, $SO_4^{2-}$, $PO_4^{3-}$, $BF_4^-$, acetate, acetylacetonate, lactate, benzoate, citrate, and tosylate. In certain embodiments, the iron (III) salt is $Fe(NO_3)_3$.

In certain embodiments, the metal dopant is tris(acetylacetonate)iron(III), ferrocene or iron pentacarbonyl.

In certain embodiments, the concentration of the metal dopant in the coating solution is between 0.001 M to 0.1 M, 0.01 M to 0.05 M, 0.01 M to 0.04 M, 0.03 M to 0.04 M, 0.01 M to 0.03 M, or 0.01 M to 0.02 M.

In certain embodiments, the metal dopant is $Fe(NO_3)_3$ and is present in the coating solution at a concentration between 0.01 M to 0.05, M 0.01 M to 0.03 M, or 0.01 M to 0.02 M.

In any of the embodiments described herein or combination of embodiments described herein, the coating solution may be an aqueous coating solution.

The methods described herein can optionally be simplified by using the same ultrasonic conditions for the second ultrasonic irradiation reaction process conditions and the second ultrasonic irradiation deposition process conditions.

The methods described herein can be used to cost effectively prepare smart textiles, such as selective or near-complete, broadband UV-radiation blocking capable textile materials or textiles that can change their optical properties either allow passage (full, partial or varying) of near-infra red radiation, or selectively block passage of near-infra red radiation), based on a phase change that occurs within the structure of the material.

UV light only accounts for <5% of solar radiation, while visible light accounts for ~50%. Over-exposure to solar ultraviolet radiation can cause sunburn, aging skin and an increased risk of skin cancer. This is all the more important as the twin dangers of i) climate change and the increasing frequency of heatwaves, and; ii) the increasing trend towards outdoor activities and active lifestyles increases the probability and risk of exposure. The subsequent risk of skin cancer is especially acute in areas of high altitude, along the equator, where the ozone layer is thinner and for those persons with lower levels of melanin in the skin.

Whilst sun-creams are an established method for sun protection, they are frequently insufficiently, irregularly and improperly applied. Likewise, UV blocking and broader solar control applications have long been recognized and used on hard substrates such as glass, e.g.; for glazing applications.[1-5] In recent years, UV blocking capability on flexible textiles/soft matter (i.e.; textile photo-protection) has also been reported by several groups as a convenient way to protect against skin damage.[6-32] Examples include $TiO_2$-based nanoparticles on silk[33], ZnO within cotton (including Ag—ZnO)[34], Au-nanoparticle heaters[35], etc.[36-40] This is driven by recent trends towards tailored 'personal micro-environment' (i.e.; via smart, wearable technologies) control strategies. Purpose-built sun-protective textiles are under-rated and underused as a simple and effective means of broadband cover. But, only a third of as-produced Spring/Summer collections currently provide proper UV protection to skin, e.g. a standard weight white, woven cotton t-shirt, as commonly worn in summer, has a UV protection factor (UPF) of[3-7], well below the ~UPF30 recommended by the WHO. In addition to biological concerns, UV radiation contributes to textile degradation and chemical modification of colored textile surfaces; this aesthetic decline reduces apparel lifetimes and exacerbates waste output issues in the textile industry.

Solar control applications refer specifically to the ability to control the passage and interactions of ultraviolet, visible and near-infra-red radiation. For example;

UV-BLOCKING: the ability to selectively or wholly block parts or all of UV radiation (i.e.; UV-A, UV-B and UV-C radiation) passage.

IR-BLOCKING: Alternatively, the ability to selectively block infra-red radiation. IR-radiation is responsible for much of the 'heat' contained in the radiation of the electromagnetic spectrum.

The concept of solar control in yarns and textiles has been explored for some time although current properties fall short of expectations. Whilst alternative materials have been explored for solar control (e.g.; nanoporous polyethylene or hybrid organic-inorganic complexes) these previously reported methods suffer from issues with optical transparency, and/or the serious negative effects on the aesthetic performance of the textile substrate. For example, even small amounts of carbon addition into a textile can turn the entire material black.

Cotton is the most popular and widely used natural textile material, across home and apparel applications. Natural and robust, the micropores on such cellulosic substrates act as micro-reactors and nucleation points for nano- and micro-particle (NMP) growth, which bind via electrostatic interactions. These micropores help constrain the size of agglomerations, allowing an effective upper band on silver NMP cluster sizes and maximizing dispersion on the surface. Further, the copious number of hydroxyl groups at the substrate surface facilitate in situ reduction of silver NMP and binding them to the surface.

Seeding strategies have been similarly used to good effect in the formation and control of microstructures in various materials.[5, 41-58] A multi-stage deposition strategy has been utilised here for durable incorporation of ZnO formation on soft matter substrates (i.e.; textile-based polymers). To the best of our knowledge, this is the first such report of seeded-growth of a crystalline metal oxide system, based entirely on a low-temperature, ambient pressure, synthesis method based on ultrasonic deposition. These durably-incorporated, thin layers have minimal physical/negative aesthetic effects on the textile/polymer material (i.e.; due to the intrinsically high visible light transmittance of wide bandgap ZnO), imparting UV-light protection. In this study, the presence of a light, randomly orientated seeding layer has provided nucleation points from which sonochemical ZnO growth proceeds.[59] The nucleation sites, allow increased coating density via hetero-epitaxial nucleation and growth versus direct growth on a soft matter, cotton substrate. The seeding layer nucleates growth, reducing ZnO coating growth induction time, by providing a lower activation energy barrier to improved film formation, yielding denser, faster growing and more adhesive coatings.[60,61]

Zinc Oxide (ZnO) is a highly effective, broad-spectrum UV-absorber, due to its relatively large bandgap (>3.37 eV). Further, extrinsic aliovalent doping strategies allow for modification and optimization of bandgap edges,[62-66] e.g. N-acceptor doping has been used to 'red-shift' the absorption edge as a result of the valence band being raised, shifting into the visible light range (from solely the UV), as compared to undoped ZnO.[44,67-76] It is also inexpensive, can be deposited on soft matter, and is considered relatively ecologically- and environmentally-benign. Further, in the thin film and nanoparticulate form, ZnO offers minimal attenuation of visible light wavelengths (400-700 nm), meaning clean, bright and unattenuated textile colours, resulting in increased textile lifetimes.[77]

In the present disclosure, seeded, crystalline-ZnO-embedded soft matter cotton fabric substrates have been fabricated using a two-step, low-temperature, sonochemical deposition method, via environmentally benign methods. Silver nanoparticle nucleation seeds were first synthesized in situ in aqueous solution and coated onto cotton substrates by an ultrasonic probe, followed by sonochemical heteroepitaxial ZnO growth in aqueous solution of zinc acetate dihydrate, ammonia, and sodium hydroxide (FIG. 1).

Sonochemistry is effective for in situ, coating with NPs via application of ultrasound radiation (20 KHz-10 MHz) in a chemical solution mixture. Upon application of ultrasound, molecules based on the chemical solution mixture, are adsorbed on the surface of the sonochemically formed acoustic bubbles. When the implosive cavitation collapse occurs, many molecules are brought together to form a nanoparticle. This acoustic cavitation process forms NPs in situ, and throws them at a substrate at high speed (>500 m/sec) via microjets, due to the bubble collapse, either forming chemical bonds with the substrate, or physically embedding in the fabric. Thus, the coating is an in situ process that occurs subsequent to the formation of the nano- and micro-particles themselves and results in strong embedding of the created materials into the desired substrate.

A second variant of the above-outlined method related to situations where the desired nanoparticles cannot be prepared sonochemically in situ. In such cases, pre-formed (either commercial or lab-made NMPs) are introduced in/via a solvent and the ultrasonic waves are utilized to launch these NMPs at high velocity and impact such that they become immobilized and embedded within the substrate.

Homogeneous, high-quality coatings can be obtained on the substrate surface using either method, although deposition parameters usually require tweaking between different materials, seeding systems, coating systems etc.

The methods described herein can also be used to prepare textiles substrates coated with $VO_2$ and $WO_3$. Such metal coated textiles can be used as 'smart materials' that can change their optical properties (namely either allow passage (full, partial or varying) of near-infra red radiation, or selectively block passage of near-infra red radiation), based on a phase change that occurs within the structure of the material. Such a phase change can be controlled and triggered through the use of temperature and/or the application of an applied electric field. Through the use of selective and controlled doping, the response conditions can be changed (e.g. the sharpness and onset of the transition temperature can be chosen based on dopant identity and concentration).

EXAMPLES

All chemicals used in this experiment were analytical grade. Distilled water was used throughout. Zinc acetate dihydrate; $(CH_3COO)_2Zn.2H_2O$ (AnalaR Normapur 99.8% VWR Chemicals), sodium hydroxide; NaOH (Unichem, 99%), silver nitrate; $AgNO_3$ (Fluka analytical ≥99.0% extra pure), ammonia solution; $NH_3$, (AnalaR Normapur VWR Chemicals Assay 31.5%), ethylene glycol (EG); $C_2H_6O_2$ (Acros 99+%), polyvinylpyrrolidone (PVP); $(C_6H_9NO)_n$ (International laboratory USA 98%), sodium chloride (NaCl); (Unichem), iron (III) nitrate nanohydrate; $Fe(NO_3)_3.9H_2O$ (Riedel-de Haën 98%).

A non-bleached, 100% woven cotton fabric, as purchased from the Able Shiny Company Limited, cut into about 3×3 inches weighing 0.726-0.765 g was used in this study. Due to the acceptance and widespread use of sonochemical technology industrially, for various uses, it can be assumed that substrate sizes and weights can readily be scaled to coat areas of far greater size (i.e. of the order of meters, and/or kilogram quantities) at a time. All the cotton fabric samples were cleaned with a non-ionic surfactant Triton X 100 (1 g $L^{-1}$) for 30 minutes at 60° C., which was further rinsed with deionized water, followed by acetone, and then dried at 60° C. in an oven.

Seeding of Silver Nano- and Micro-Particles on Cotton Fabric: The cleaned cotton fabric substrate was subjected to ultrasonic irradiation for seeding of silver nanoparticles. Three different concentrations of silver nitrate (11.25, 21.5 and 43 mM) were studied in the aqueous seeding solution; a wider range of silver nitrate aqueous seeding solutions is thought readily possible for use. To make the solution, EG (31.6 ml) was mixed with PVP (5 ml) and then NaCl (0.5 g) dissolved in DI water (20 ml) was added to the EG and PVP mixture. Subsequently, silver nitrate was added and subjected to ultrasonic irradiation at 20 kHz, 50% amplitude at 750 W for 90 minutes, until the reaction mixture turned a wine-red color, indicating the formation of silver nanoparticles. At this point, the cotton fabric, pre-dipped in 3 ml of EG, was immersed in the above aqueous silver seeding solution and sonication under the above-mentioned conditions was continued for 30 minutes, to form silver seeds on the fabric. At the end of seeding reaction, black patches of silver were observed, indicating the successful silver seeding on the cotton fabric. Black patches need not be present/observable for seeding to take place or for the method to still be effective. The silver seeded cotton fabrics were dried for 24 hours at 60° C. In another variant of the experiment, samples can be pat dried after sonication and then transferred to the second coating mixture, without need for an additional drying step.

Preparation of Iron (Fe)-Doped Zinc Oxide (ZnO) on Silver Seeded Cotton Fabric

An aqueous coating solution was prepared by adding aqueous ammonia (100 ml, 28% m/v) and distilled water (68 ml) to a vessel. NaOH (4 g) and $Zn(OAc)_2$-dihydrate (9.25 g) was added to the resulting solution. The silver seeded textile substrate was dipped in 50 ml of the above-prepared aqueous coating solution and sonicated by irradiating at 20 kHz, a power of 750 W, at 40% of amplitude for 60 minutes. The concentration of zinc precursor was maintained constant throughout the experiment, but deposited on a cotton fabric of different silver seed loading (i.e. as a result of the variation in silver (I) nitrate concentration—11.25, 21.5 and 43 mM—as outlined above). The different silver loadings were observed to positively correspond to increasing growth density of ZnO overlayer/second coatings on cotton fabrics.

Figure 2:
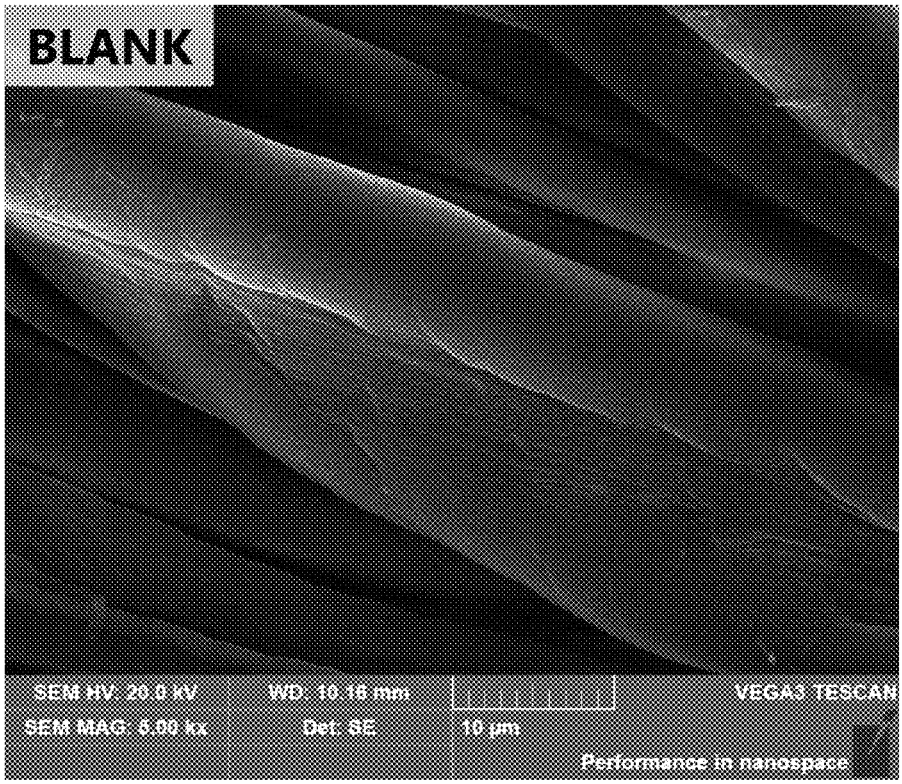
FIG. 2 depicts illustrative scanning electron microscopy (SEM) images of BLANK: Pre-treated cotton with no coating; A: 11.25 mM $AgNO_3$ seeded on cotton fabric (no overcoat); B: 22.5 mM $AgNO_3$ aqueous seeding solution on cotton fabric (no overcoat); C: 43 mM $AgNO_3$ aqueous seeding solution on cotton fabric (no overcoat); D: 11.25 mM $AgNO_3$ aqueous seeding solution; and seeded—ZnO overcoat prepared from 0.3 M $Zn(OAc)_2$ aqueous coating solution on cotton fabric; E: 22.5 mM $AgNO_3$ seeded—0.3 M ZnO overcoat prepared from 0.3 M $Zn(OAc)_2$ aqueous coating solution on cotton fabric; F: 43 mM $AgNO_3$ seeded—0.3 M ZnO overcoat prepared from 0.3 M $Zn(OAc)_2$ aqueous coating solution on cotton fabric.
Figure 2:
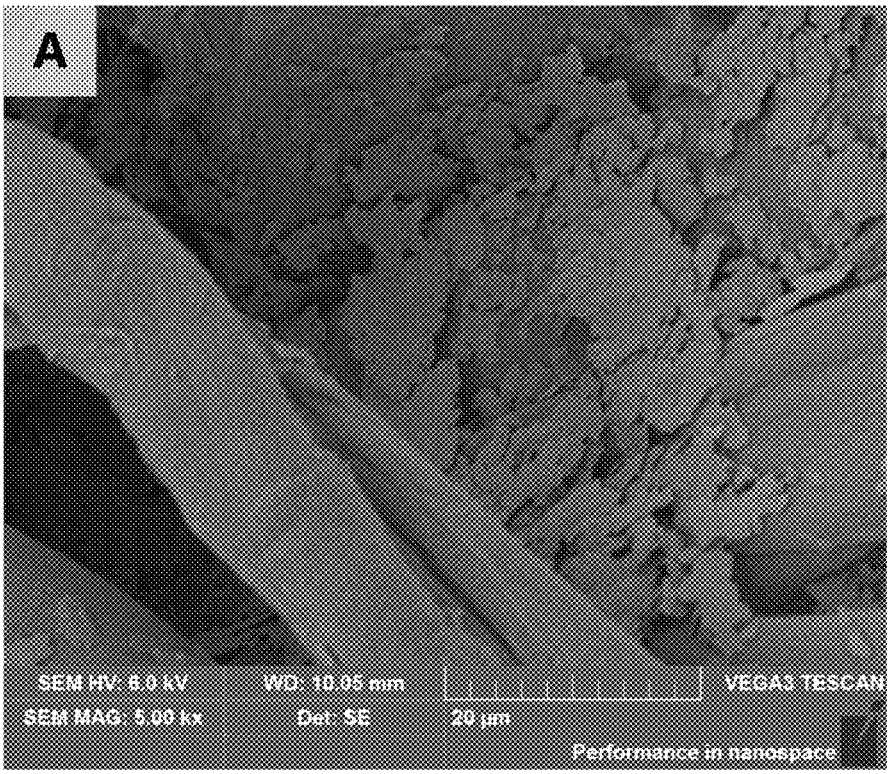
Figure 2:
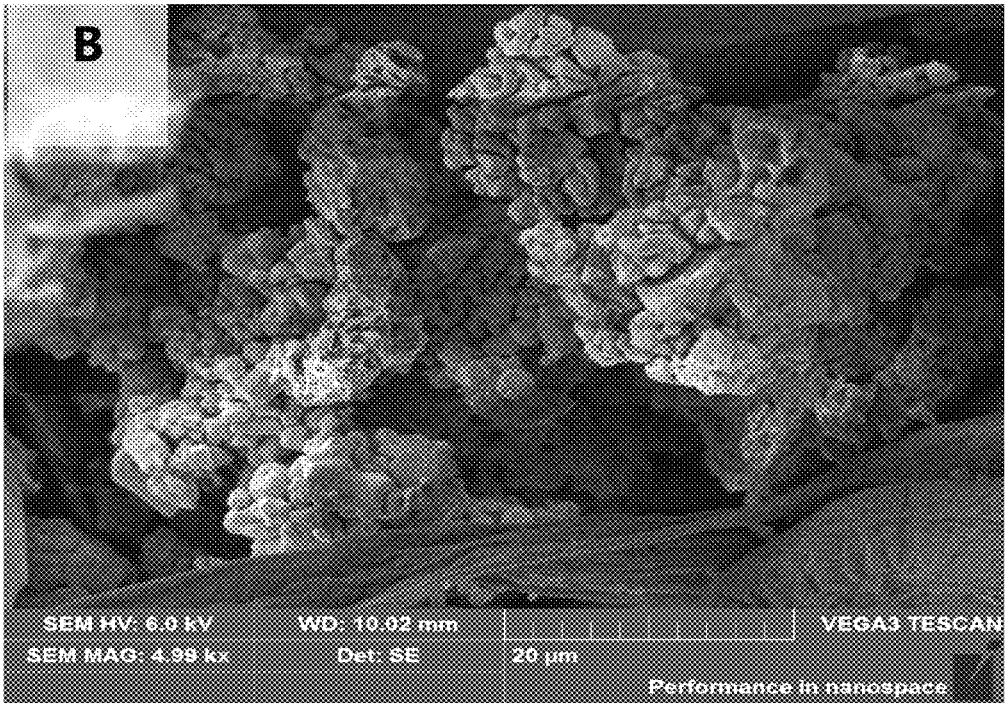
Figure 2:
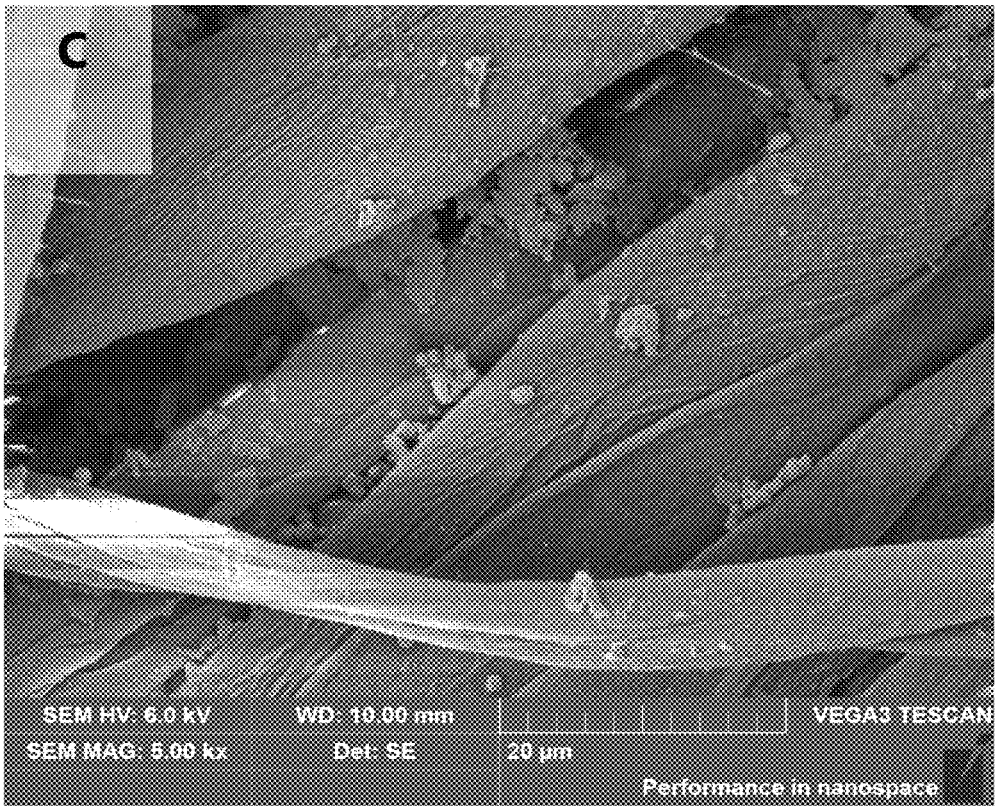
Figure 2:
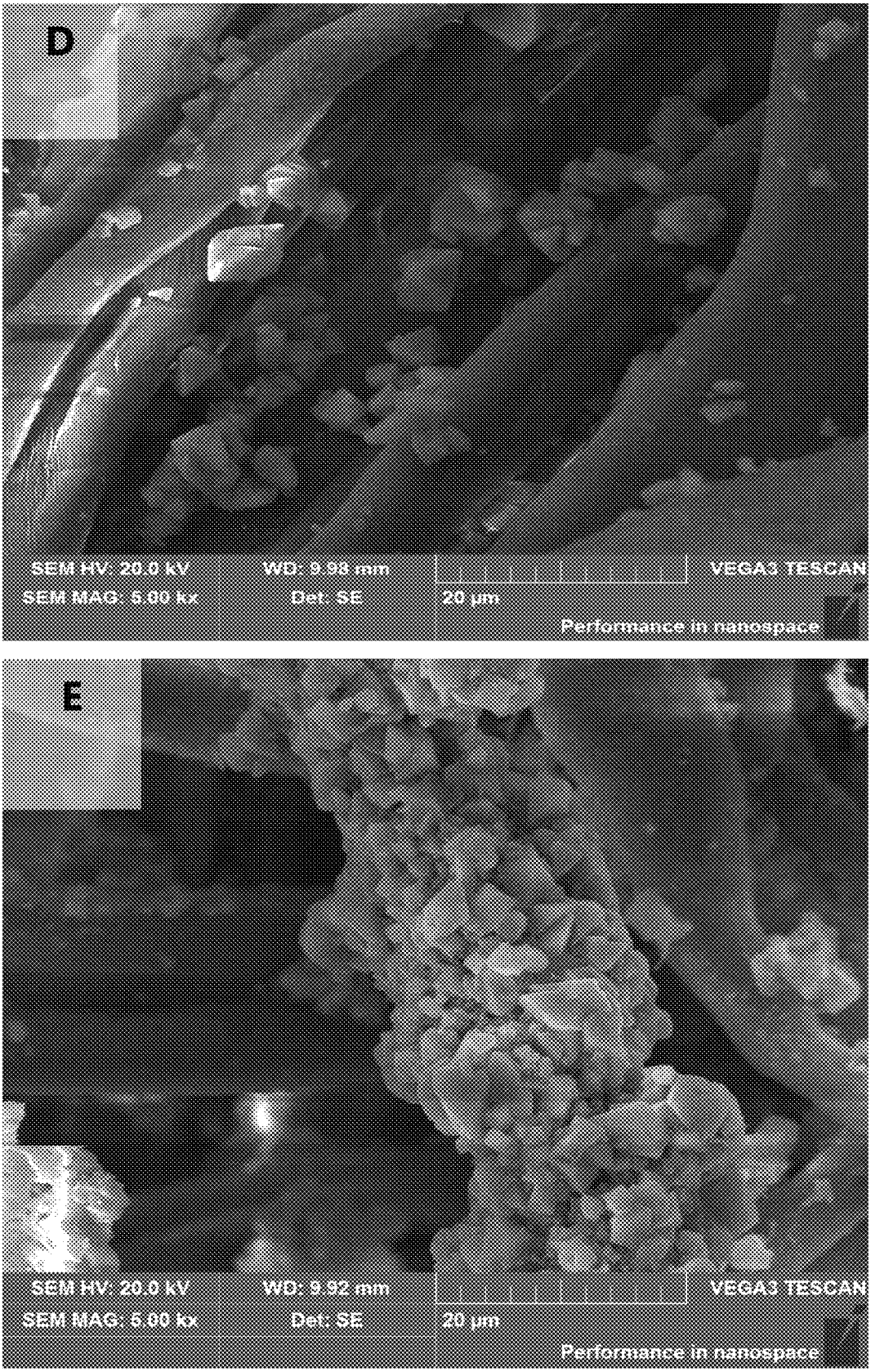
Figure 2:
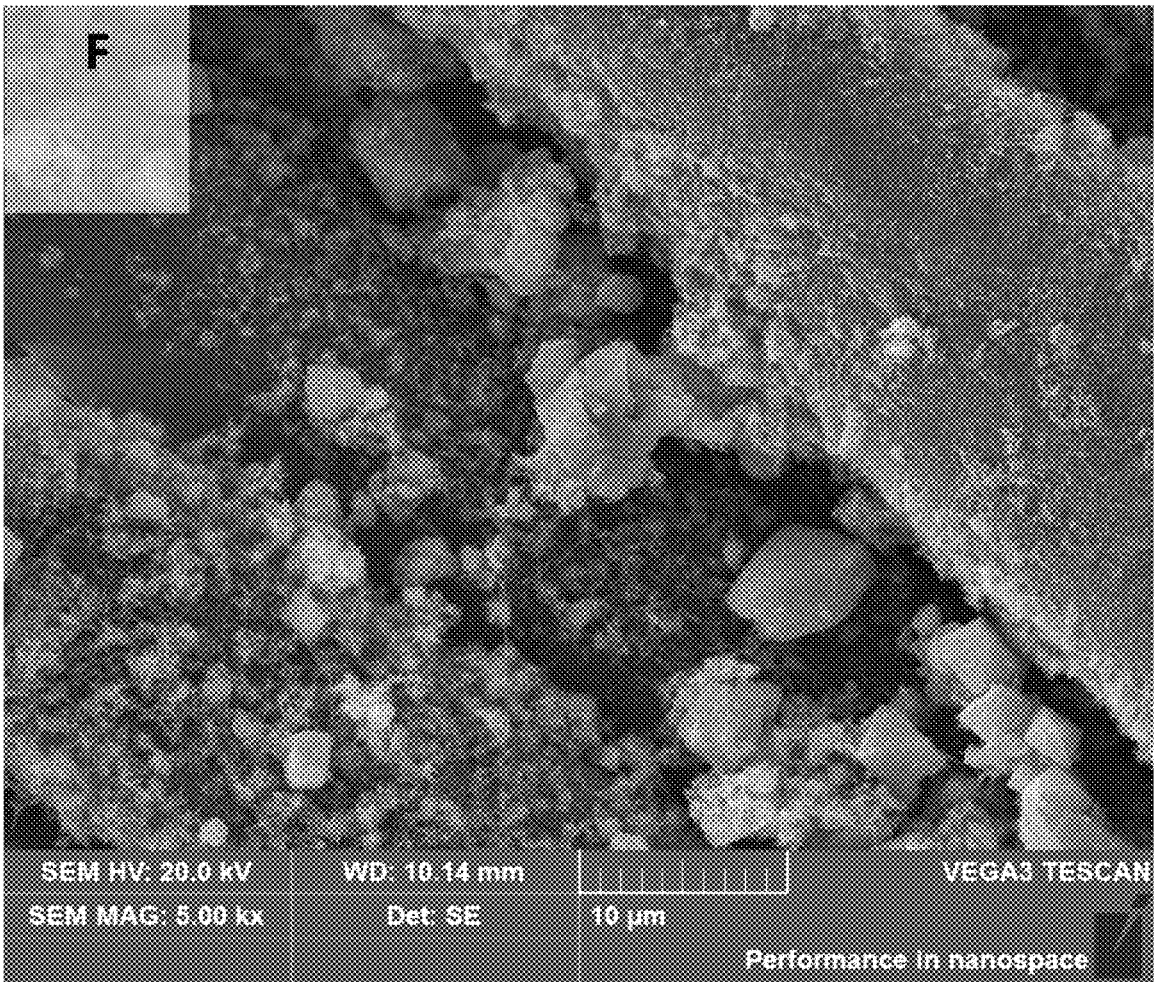

To control UPF (ultraviolet protection factor) more precisely, by obtaining a pure-phase, crystalline wurtzite ZnO structure, iron-doped zinc oxide was also deposited on silver preformed fabric. The concentration of iron doping was varied from 0.01 M to 0.05 M, without changing any of the other above-stated reaction conditions. The Fe-doped ZnO was in-situ deposited on silver preformed fabrics using ultrasonic irradiation at 20 kHz, a power of 750 W, at for 60 minutes at 40% amplitude. After deposition, the woven cotton fabrics were rinsed with distilled water to neutral conditions (pH=7) and then dried overnight in an oven. The synthesized cotton fabrics were fully tested for their morphology, structural and elemental states as well as optical properties pertaining to ultraviolet protecting properties (FIG. 2).

Figure 3A:
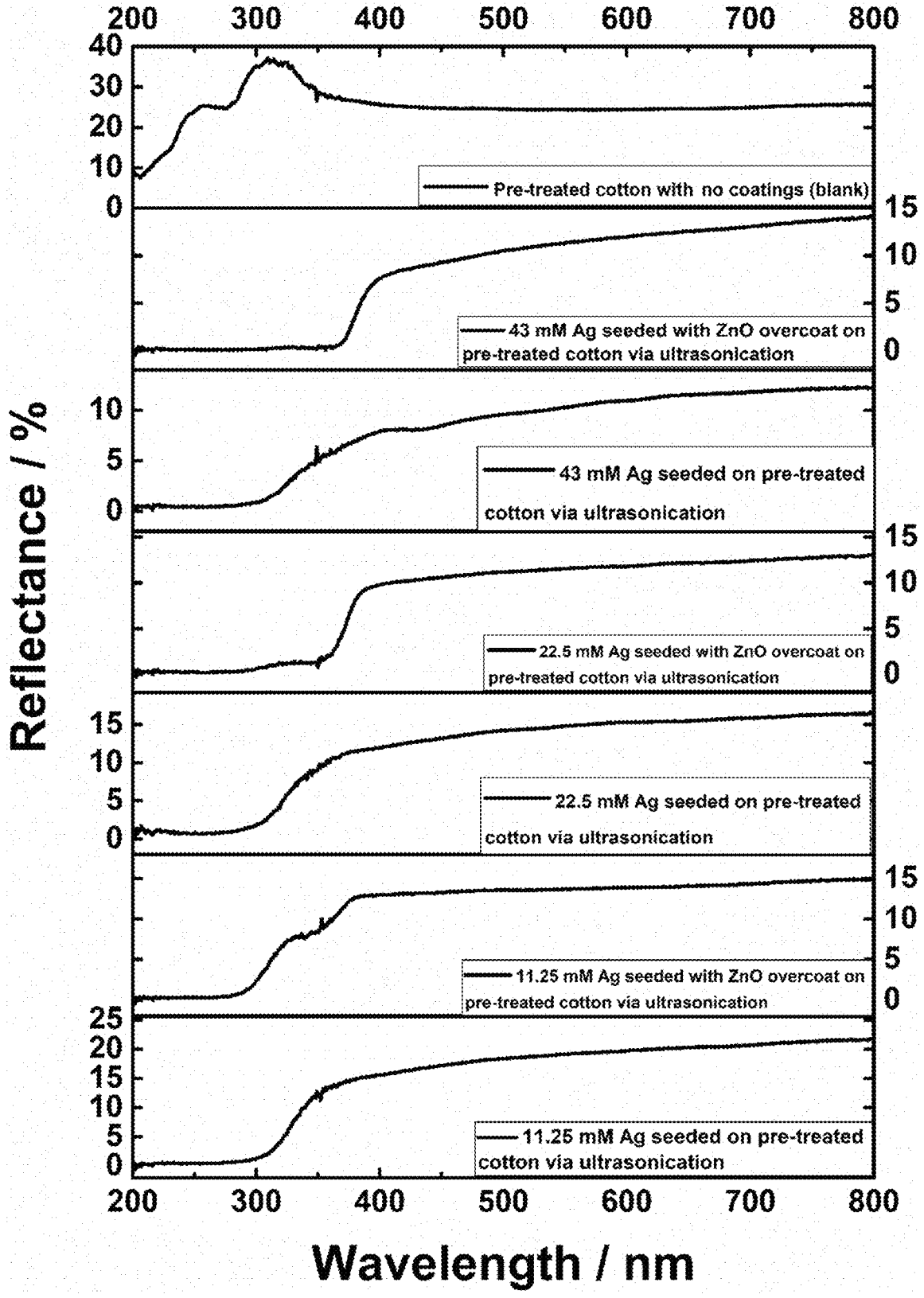
FIG. 3A depicts illustrative UV-vis reflectance spectra indicating the changing optical properties of bare, silver-seeded, and silver-seeded and zinc oxide over-layered coated cotton substrates.
Figure 3B:
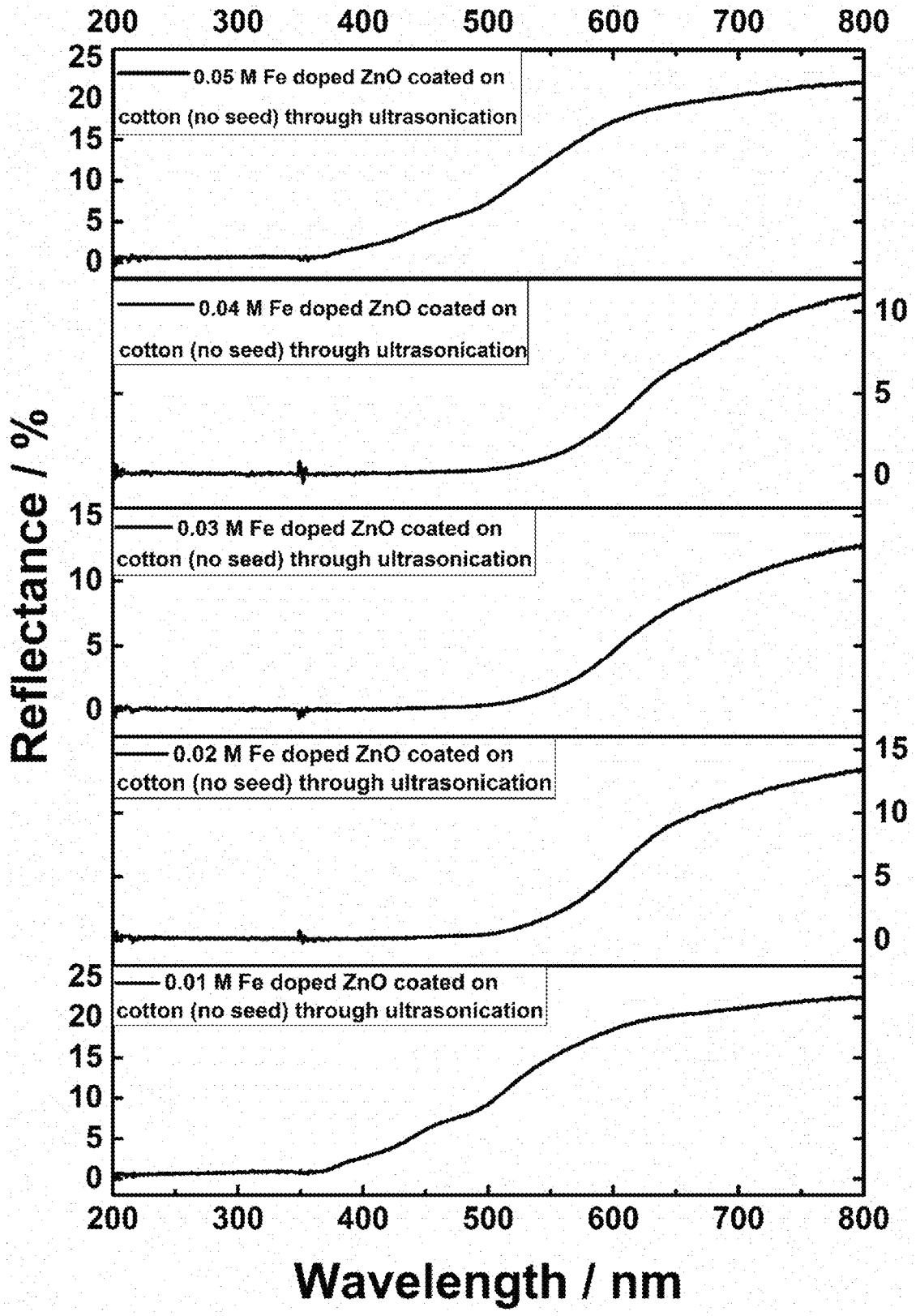
FIG. 3B depicts an illustrative UV-vis reflectance spectra indicating the changing optical properties of iron-doped zinc oxide coated cotton substrate samples.

In the case of the ultrasonic method, even without the presence of a seed, a highly crystalline, pure-phase powder can be obtained, when a correct amount of dopant is used. Otherwise, oftentimes, a mixed-phase, crystalline system is obtained when no dopant is used. However, for effective incorporation into soft matter substrates (i.e. polymeric textiles), the use of seeds (in this case silver seeds, although others are also possible), is required for the dense and effective growth of ZnO. A higher growth of ZnO NMP results in earlier (i.e. red-shifted) UV-vis-near IR absorption onsets, for the as-prepared samples (FIG. 3). A higher seed concentration (i.e. silver in this case), resulted in a greater number of seed/nucleation sites being created, of smaller sized clusters with weaker agglomeration. This in turn resulted in denser, but smaller sized clusters in the second coating layer/overlayer. This then resulted in higher optical absorbance and band gap absorption onset energies being detected in terms of the overall coating's optical characteristics.

ZnO-incorporated fabric demonstrates a ultrahigh UPF protection than that of untreated ones, due to its high content of crystallinity as well as the possible separation efficiency of electron and hole pairs and quantum confinement effects.[22] Thus, UPF values far in excess of 50 (the maximum advertised value conventionally), e.g. values far exceeding UPF 100, can be obtained under certain conditions. Moreover, the UV-blocking activity of the nanocomposites-treated fabrics was improved by the presence of silver nanoparticles on the surface of cotton fabrics. This is perhaps due to the UV reflection ability of the silver nanoparticles, coating cotton fabric, with Ag/ZnO nanocomposites leading to a more significant increase in UV absorbance values.[78] This beneficial effect of seeding is combined with the strong UV absorption capability (due to the moderately sized bandgap) and strong scattering from the relatively rough ZnO surface coating, which causes light scattering that reduces transmittance of incident UV light/radiation, to some extent.

The textile fibers act as a template capable of maintaining the size and polydispersity of the prepared ZnO NMPs with good uniformity. It is also likely that ZnO colloidal particles are confined inside the fibril and micro-fibrils of cotton fibers. In line with previous reports, the synthesis route for in situ ZnO formation was thought to progress via the structurally correlated hydroxide intermediates ($Zn(OH)_2$ and $Zn(OH)_4^{2-}$); thought favourable in the alkaline hydrolysis process (i.e.; ammonia) encountered here:[11]

$$NH_3+H_2O \rightarrow NH_4^+ + OH^-$$

$$Zn^{2+}+2OH^- \rightarrow Zn(OH)_2$$

$$Zn(OH)_2 \rightarrow ZnO+H_2O$$

Figure 4A:
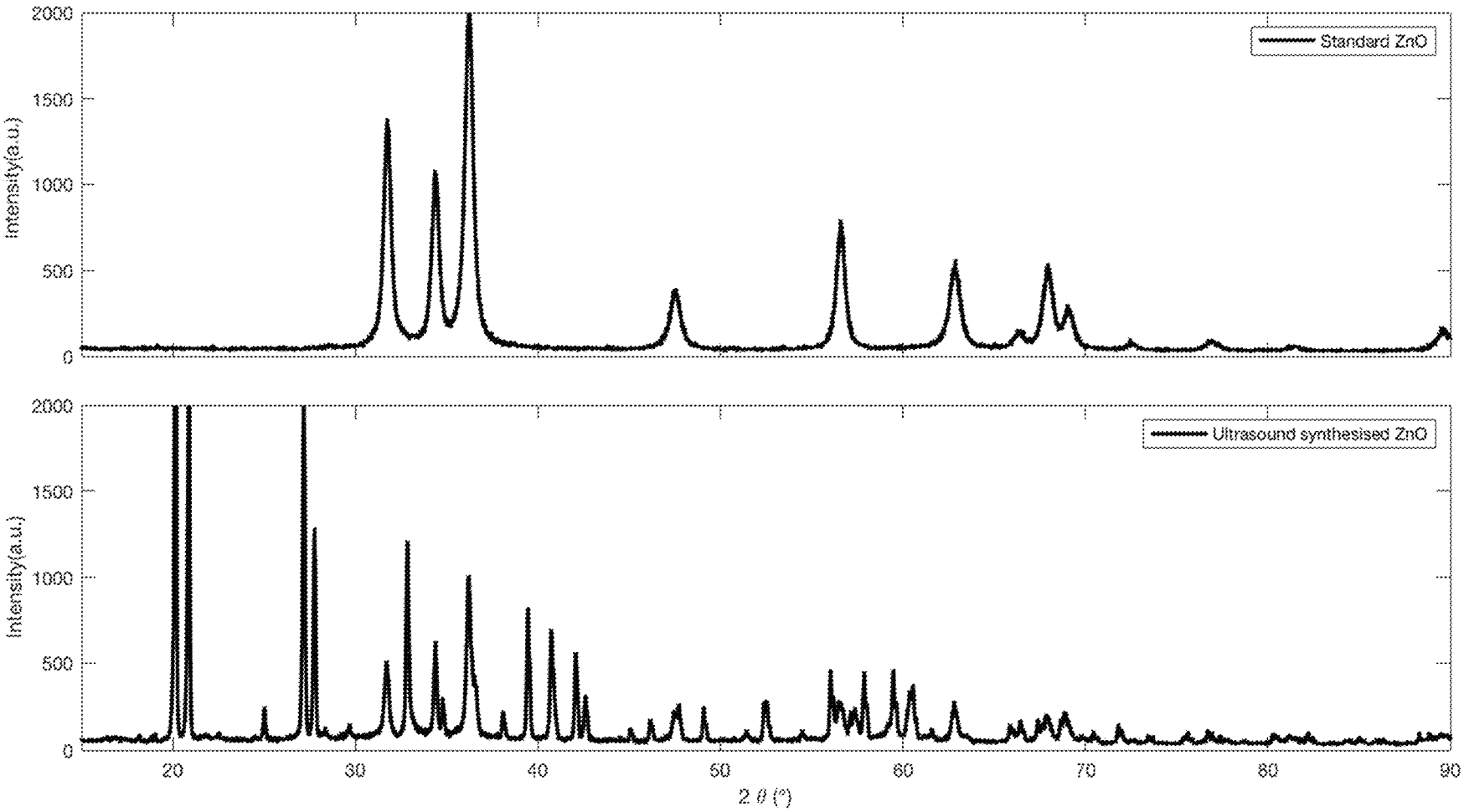
FIG. 4A depicts illustrative XRD patterns of metal coatings deposited in accordance with certain embodiments described herein demonstrating the ability to form highly pure, single-phase, highly crystalline metal oxides. XRD pattern of a reference standard pure-phase ZnO sample (top) as well as a mixed-phase system as-obtained from a basic sonochemical synthesis (bottom).
Figure 4B:
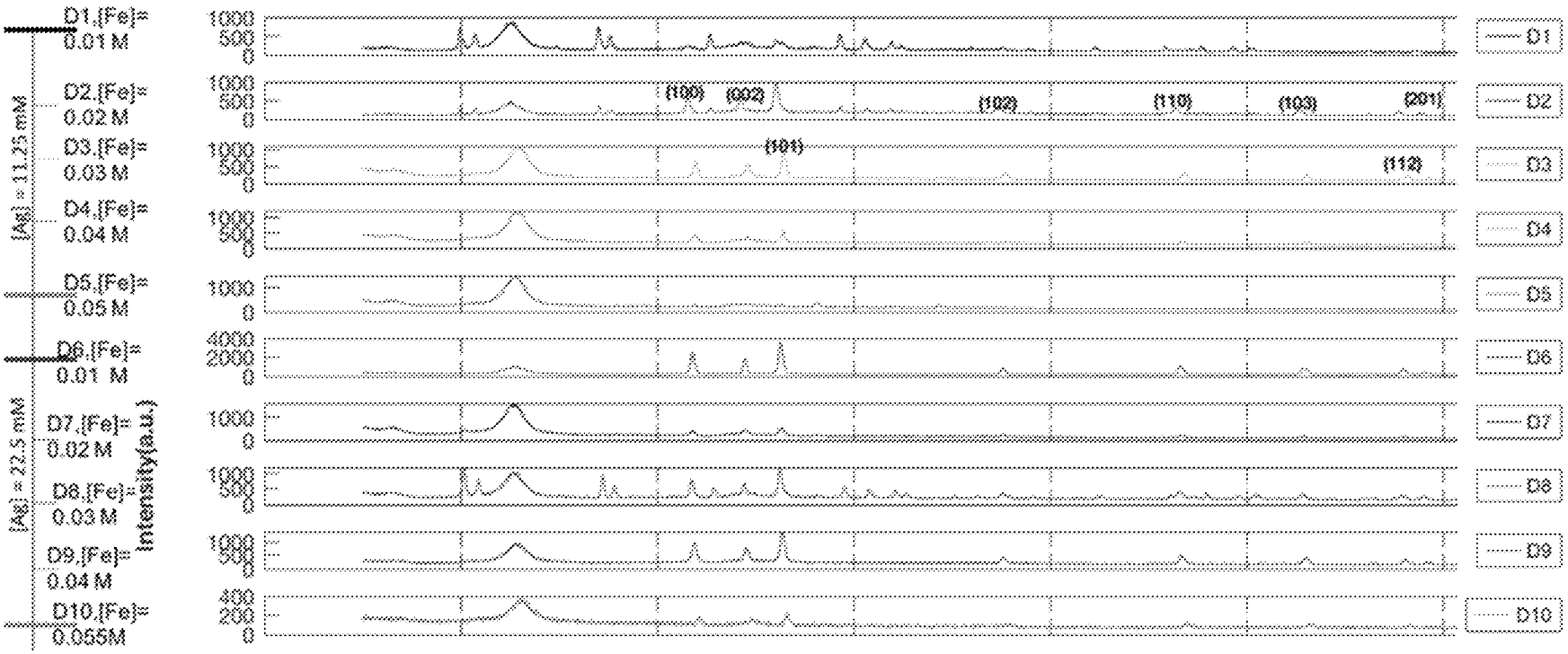
FIG. 4B depicts illustrative XRD patterns demonstrating the ability to form highly pure, single-phase, highly crystalline metal oxides methods described herein. XRD patterns illustrating the ability to obtain substantially pure phase ZnO on cotton substrates through the use of iron-doping using the methods described herein from aqueous seeding solutions comprising 11.25 mM, 21.5 mM, and 43 mM concentrations of $AgNO_3$; and from aqueous coating solutions comprising 0.3 M $Zn(OAc)_2$ and between 0.01 M to 0.05 M $Fe(NO_3)_3$, in the sonochemical synthesis procedure described herein.
Figure 4C:
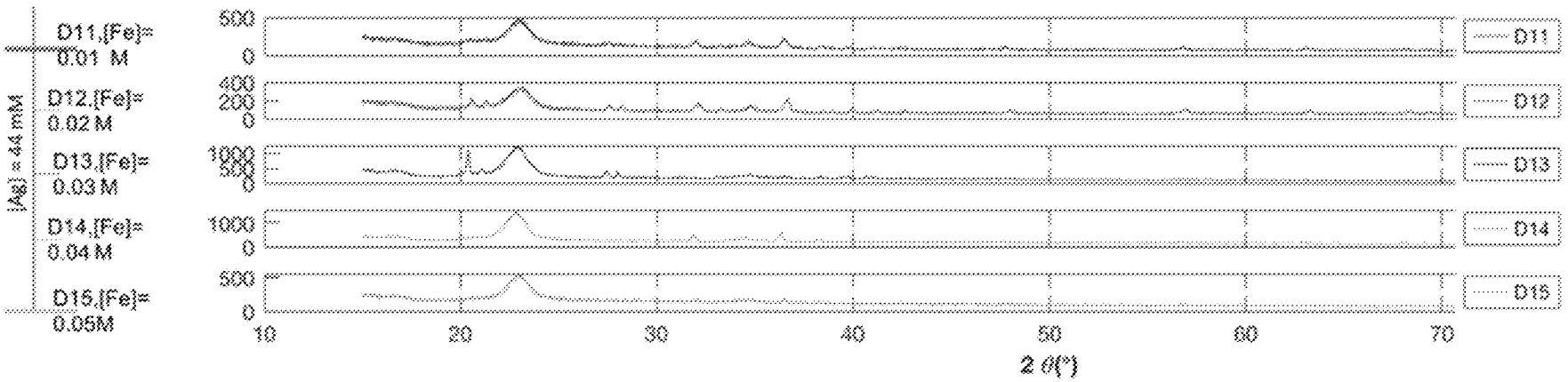
FIG. 4C depicts illustrative XRD patterns demonstrating the ability to form highly pure, single-phase, highly crystalline metal oxides, using the sonochemical deposition method. XRD patterns illustrating the ability to obtain substantially pure phase ZnO on cotton substrates through the use of iron-doping using the methods described herein, in the sonochemical synthesis procedure described herein from aqueous coating solutions comprising 0.3 M $Zn(OAc)_2$ and between 0.01 M to 0.05 M $Fe(NO_3)_3$.

The experimental data seemingly support the above transition, due to isolation of relatively high-purity $Zn(OH)_2$ XRD patterns, extracted during the synthesis process (FIG. 4). This route is seemingly a universal route for the low-temperature, solution based alkaline synthesis of ZnO, regardless of initial zinc precursor; $Zn(acac)_2$ was utilized here, whilst $Zn(NO_3)_2$ has been widely reported elsewhere.

It is challenging to find ideal reaction mixtures of zinc precursors, to achieve efficient coating on the substrate. Initial trials included the combinations of zinc acetate dihydrate, water, ethanol, and sodium hydroxide which did not lead to desire coating expectations.

After narrowing down to appropriate zinc precursors, reaction conditions such as ultrasonic probe amplitude, duration of ultrasound reactions etc. were optimized to obtain better quality zinc oxide products.

In later stages of the experiments, the different silver loading rates were studied, which showed that varying densities of ZnO growth occurred on cotton fabric at different concentrations of silver; there was a positive correlation with the presence and extent of seeding, with the density of ZnO grown in the overlayer/second coating.

At higher concentrations of silver seeding, a higher density of ZnO growth was observed due to a greater number of nucleation points. This was reinforced by SEM images, which showed varied growth density of ZnO, in addition to the UPF test data, which showed a relatively lower UPF rating when lower concentrations of silver were used (which in turn meant that there was decreased growth and density of ZnO).

Preparation $TiO_2$ on $Ag_2S$ Seeded Cotton Fabric Cotton Fabric $Ag_2S$ Seeding on Fabric Substrate 200 mg of $AgNO_3$ was dissolved in 20 ml of deionized water, 20 mg of trisodium citrate anhydrous was added to $AgNO_3$ solution. The resulting solution is subjected to ultrasonic irradiation at 20 kHz, a power of 750 W, for 3-5 minutes at 40% amplitude.

20 mg of sodium thiosulphate was dissolved in 10 ml deionized water. 0.5-1 ml of above prepared sodium thiosulphate solution was added as a reducing agent to silver nitrate mixture.

The non-bleached mercerized cotton fabric substrate was immersed in the above reaction mixture and sonochemical seeding was carried using ultrasonic irradiation at 20 kHz, a power of 750 W, for 30 minutes at 40-50% amplitude. This seeded substrate was used as-is, without any further processing, for the next stage of overcoating.

$TiO_2$ Overcoat on the $Ag_2S$ Seeded Fabric Substrate 5 ml of titanium isopropoxide $Ti(OCH(CH_3)_2)_4$ was added to 10-15 ml of deionized water.

The freshly seeded (without any pre-drying) $Ag_2S$ seeded cotton fabric substrate was immersed in the above titanium alkoxide reaction mixture and sonication was carried out using ultrasonic irradiation at 20 kHz at 750 W for 30 min at 50% amplitude.

The $TiO_2$ coated fabric substrate were thoroughly washed in deionized water and dried in air at 60-70° C.

Preparation of ZnO on $Al_2O_3$ Seeded Cotton Fabric Cotton Fabric

Aluminum chloride hexahydrate (4 g) was dissolved in deionized water (50 ml). sodium hydroxide (0.3 g) was then added to prepare the aqueous seeding solution.

The pre-treated fabric substrate were immersed in the aluminum chloride aqueous seeding solution and sonicated using ultrasonic irradiation at 20 kHz at 750 W for 1 hr at 40% amplitude.

The $Al_2O_3$ seeded fabric substrate was thoroughly washed in deionized water, dried for 4 hrs at 60° C. in air.

ZnO Overcoat on the $Al_2O_3$ Seeded Fabric Substrate

An aqueous coating solution was prepared by adding aqueous ammonia (100 ml, 28% m/v) and distilled water (68 ml) to a vessel. NaOH (4 g) and $Zn(OAc)_2$-dihydrate (9.25 g) was added to the resulting solution. The $Al_2O_3$ seeded textile substrate was dipped in 50 ml of the above-prepared aqueous coating solution and sonicated by irradiating at 20 kHz, a power of 750 W, at 40% of amplitude for 60 minutes.

A general summary of the sonochemical deposition of ZnO on textile substrates according to certain embodiments described herein is outlined below:

Step 1: Refinement of the seeding presence requirement and relationship with variations in seed concentration;

Step 2: Optimization of ultrasonic probe parameters in terms of wattage and amplitude;

Step 3: Optimization of deposition times;

Step 4: Incorporation of dopants into the main ZnO structure so as to obtain the desired optical properties; and Step 5: Substrate preparation (e.g., pre-treatment with ethylene glycol) in order to maximize silver incorporation and reduction in situ.

The in-situ deposition of Fe-doped ZnO on silver loaded fabrics showed a major shift in UV-vis-near IR—reflectance properties. The undoped ZnO coating on silver loaded fabrics showed a peak UV transition ranging from 360-380 nm, whereas the Fe-doped ZnO on silver loaded fabric showed a drastic red-shift of the bandgap absorption edge peak starting at 580 nm.

The silver seeded fabrics can yield high-performance Fe-doped ZnO coating with reduced leaching and, which can sustain a greater number of washes compared to non-silver seeded fabrics, while maintaining their functional properties.

The claimed ultrasound-based sonochemical synthesis method enables in-situ growth and deposition of metal oxides on soft matter polymeric substrate by way of a light seeding layer (either metal or metal oxide), can be performed at a lower temperature than current conventional deposition methods (which usually makes them unsuited to soft matter coating), and ambient pressure. The claimed method can be readily scaled and adopted at industrial scale.

The surface of the textile substrates, either in the form of beads, pellets, fibres or filaments, or fabricated into a larger material (e.g. by knitting, weaving, felting, compacting etc.), is treated by coating with at least two coatings having the same or different compositions with at least two coatings of inorganic materials: the first coating being either metal or metal oxides, and the second being an oxide coating.

The deposition of sub-layers has several advantages. For example, promoting the adhesion of the main coating and allowing greater control over the selectivity and response with respect to the optical properties (absorbance, transmittance, reflectance, scatter/haze) of the solar control coating.

Metals of silver, gold, platinum, palladium, copper or nickel are options for use as seed layers.

Oxides of zinc, vanadium, tungsten, tin, titanium, germanium, cadmium, copper indium, thallium or bismuth are options for use either as seed layers and/or as the second coating/overlayers.

The above-mentioned coatings methods can be either homo- or hetero-epitaxial.

Further, a method of isolating a highly crystalline, substantially pure ZnO wurtzite phase (i.e., not mixed phase), has been found through light doping of the parent metal oxide system. This suppresses mixed phase products and the synthesis can all be done under the low synthesis conditions (i.e. ambient temperature and pressure environments for both ultrasonic probe seeding and overlay; ultrasonic probe temperature can reach up to 180° C. during sonochemical deposition processes, as measured by an IR thermometer.

Chemical coating by reaction and/or decomposition and/or degradation of compounds in solution mixtures (i.e. the major solution 'vehicle' being either polar solvents including water and tetrahydrofuran (THF); or non-polar solvents such as toluene; or even combinations of both—i.e.; "oil-in-water emulsions"), i.e. sonochemical deposition (SD) processes, by the method of coating characterized by the use of chemical reaction mixtures whose components are durably and selectively incorporated within the desired substrate as a result of the acoustic cavitation processes involved in the sonochemical deposition method.

Deposition methods from solutions or suspensions of single- or multi-component reaction mixtures via SD, of the following functional materials types:

transparent conductive oxide layers (TCO) being part of a multilayer coating, and/or;

thermochromic metal oxides (TMO) being part of a multilayer coating, and/or;

UPF-enabling metal oxides being part of a multilayer coating.

In certain embodiments of the methods described herein, the metal or metal oxide synthesis can occur at a lower temperature (≈250° C. or lower), while the existing/conventional technologies are extremely expensive to run and maintain at such a low temperature.

In certain embodiments of the methods described herein, the metal or metal oxide synthesis can occur at ambient pressure (i.e.; no high pressure or vacuum technologies required), while the existing/conventional technologies are extremely expensive to run and maintain at ambient pressure.

In certain embodiments of the methods described herein, the seeding step in which the seed layer acting as nucleation and strong anchoring sites, results in durable incorporation of inorganic systems into textile substrate. This overcomes the leaching/sloughing issue which has always plagued NMP incorporation into soft matter polymeric textiles. Seed layer provides strong anchoring for doped metal oxide coating and is expected to perform well under harsh conditions, even after multiple washes.

In certain embodiments of the methods described herein, the second coating/layer/overlayer comprising crystalline metal oxide (doped or undoped; single- or mixed-phase) can advantageously be controllably and durably incorporated with good adhesion. The presence of the seed layer also allows precise control of solar control characteristics (e.g. UPF properties), on such textile substrates—allowing for partial or complete blocking of desired UV-visible-near IR radiation wavelengths (e.g.; UV-A, -B, and/or -C for UPF applications).

In certain embodiments of the methods described herein, with correct doping and control, pure-phase metals and metal oxides can be obtained.

Furthermore, the doped system in certain embodiments of the methods described herein enables individual tweaking and control of the optical characteristics (transmittance, reflectance, absorbance, scatter/haze) over specific wavelength zones of UV (A, B and C) radiation; in the case of UPF functionality.

This unique seeded ultrasound method allows for reproducible coating of a wide-range of textile substrates.

While literature reports of homo- and heteroepitaxial growth of metal oxides are very commonly reported on hard substrates, there are few reports on soft matter (due to the previously highlighted unfavourable deposition conditions), such as textile substrates. More specifically, the heteroepitaxial growth of metal oxide on a soft substrate (in this context textile substrates) has not yet been reported.

Other advantages of the methods described herein are as follows: 1) it provides a simpler system; 2) cheaper to manufacture; 3) the claimed method achieves higher performance substrates as compared to other incorporation methods; 4) potentially quicker to manufacture: according to certain embodiments described herein, materials can be made and incorporated in situ. The entire process, including preparations and transfers, can take 1-4 hrs. In other systems, if setup time is taken into account, those methods can stretch anywhere from several hours to several days; 5) the technology is highly scalable, and ultrasound based systems are very common in the beverage and cosmetics industries. As such, the methods described herein can readily be scaled for larger-scale industrial production/adoption; 6) the raw materials used in the methods described herein are widely used across different sectors and are cheaply available; 7) the reproducibility of the process on a wide variety of textile substrates offers flexibility to manufacturers to choose and adapt for their current product line; 8) the process does not involve any expensive or complex equipment and cheaper raw materials make it affordable for manufacturing; 9) the disclosure combines robust performance using less complex process making it more attractive for commercial adopters; 10) the seamless process, minimal moving parts, availability of raw materials, flexibility over any substrate and affordable manufacturing without compromise in the performance makes this disclosure stand out for any commercial adopters.

The above-mentioned advantages are realized particularly by the following technical features: 1) seeded growth (silver-based hetero-epitaxial methods used in the UPF example given above) is expected to provide excellent wash fastness of the metal coating; 2) excellent growth density of metal or metal oxide coating is observed as a result of the seeding method on fabrics when compared against non-seeded coating; 3) according to the preliminary analysis, a successful attempt has been made using simple two-step ultrasound technique to develop the seed-mediated growth of metal oxide and doped metal oxide coatings on soft matter polymeric substrates; and 4) a reproducible method at ambient pressure and relatively low temperatures.

To prove that the heteroepitaxial growth of metal oxide systems provide excellent durability of the inorganic coating to soft matter polymeric substrates, leaching tests and wash durability tests are being carried out to definitively evaluate the performance. The leaching tests can be carried out by the American Association of Textile Chemists and Colorists (AATCC) test method 61-2006 (i.e. the AATCC method) or the ISO105-C10:2006 method. For the AATCC method, an AATCC standard washing machine (Launder Ometer) and detergent (AATCC standard detergent WOB) were used. Samples were cut into 5×15 cm2 swatches and put into a stainless-steel container with 150 mL 0.15% (m/v) WOB detergent solution and 50 steel balls (0.25 inch in diameter) in a thermostatically controlled water bath at 49° C. for various washing times to simulate 5, 10, and 20 wash cycles of home/commercial laundering. When the ISO105-C10: 2006 method is used, samples of 100 mm×40 mm were prepared. The wash liquor was prepared by dissolving 4 g of detergent per liter of water. Approximately 1 g of fabric was placed into polyethylene bottles (50 mL with a tight fitting cap to withstand the extra pressure created by oxidizing agents in some solutions) containing 5 polyethylene balls and 20 mL of wash solution. A 45 min program at 40° C. and 40±2 rpm with steel vessels (75±5 mm diameter, 125±10 mm height, 550±50 mL) tumbling end-over-end with two rinse cycles was followed[79-82]. After each wash cycle, the fabrics were removed and dried at 60° C. in an oven before the next wash cycle commenced. We are completing data acquisition on a model ZnO system for UPF applications.

Test results show that in the case of ZnO formation, a mixed phase (ZnO and $Zn(OH)_2$) system is present when a seeding layer is present. ZnO is markedly absent without the use of the seeding layer.

The greater the extent of seeding, the higher is the density of growth.

Further, a method of isolating a highly crystalline, pure ZnO wurtzite phase (i.e.; not mixed phase), has been found through light doping of the parent metal oxide system. This suppresses mixed phase products and the synthesis can all be done under the low synthesis conditions (i.e.; ambient temperature and pressure environments for both ultrasonic probe seeding and overlay; ultrasonic probe temperature can reach up to 180° C. during sonochemical deposition processes, as measured by an IR thermometer.

REFERENCE

1. Manning, T. D., Parkin, I. P., Pemble, M. E., Sheel, D. & Vernardou, D. Intelligent Window Coatings: Atmospheric Pressure Chemical Vapor Deposition of Tungsten-Doped Vanadium Dioxide. *Chem. Mater.* 16, 744-749 (2004).

2. Granqvist, C. G. Electrochromics and Thermochromics: Towards a New Paradigm for Energy Efficient Buildings. in *Materials Today: Proceedings* 3, S2-S11 (2016).

3. Granqvist, C. & Niklasson, G. Thermochromic Oxide-Based Thin Films and Nanoparticle Composites for Energy-Efficient Glazings. *Buildings* 7, 3 (2016).

4. Granqvist, C. G. in *Eco-efficient Materials for Mitigating Building Cooling Needs: Design, Properties and Applications* 442-471 (Woodhead Publishing, 2015). doi:10.1016/B978-1-78242-380-5.00016-9

5. Taylor, A. et al. A bioinspired solution for spectrally selective thermochromic $VO_2$ coated intelligent glazing. *Opt. Express* 21, A750-A764 (2013).

6. Tran Thi, V. H. & Lee, B. K. Development of multifunctional self-cleaning and UV blocking cotton fabric with modification of photoactive ZnO coating via microwave method. *J. Photochem. Photobiol. A Chem.* 338, 13-22 (2017).

7. Zhang, Y. H., Xin, J. H., Daoud, W. A. & Hao, X. *UV-blocking properties of silica/titania hybrid nanocomposites. Key Engineering Materials* 334-335 II, (2007).

8. Wang, R. H., Xin, J. H. & Tao, X. M. UV-blocking property of dumbbell-shaped ZnO crystallites on cotton fabrics. *Inorg. Chem.* 44, 3926-3930 (2005).

9. Mao, Z., Shi, Q., Zhang, L. & Cao, H. The formation and UV-blocking property of needle-shaped ZnO nanorod on cotton fabric. *Thin Solid Films* 517, 2681-2686 (2009).

10. Li, R. et al. Study on synthesis of ZnO nanorods and its UV-blocking properties on cotton fabrics coated with the ZnO quantum dot. *J. Nanoparticle Res.* 16, (2014).

11. Xin, J. H., Daoud, W. A. & Kong, Y. Y. A New Approach to UV-Blocking Treatment for Cotton Fabrics. *Text. Res. J.* 74, 97-100 (2004).

12. Hu, X., Tian, M., Qu, L., Zhu, S. & Han, G. Multifunctional cotton fabrics with graphene/polyurethane coatings with far-infrared emission, electrical conductivity, & ultraviolet-blocking properties. *Carbon N. Y.* 95, 625-633 (2015).

13. Li, Y., Zou, Y. & Hou, Y. Fabrication and UV-blocking property of nano-ZnO assembled cotton fibers via a two-step hydrothermal method. *Cellulose* 18, 1643-1649 (2011).

14. Li, C. et al. The formation and UV-blocking property of flower-like ZnO nanorod on electrospun natural cotton cellulose nanofibers. *Fibers Polym.* 15, 281-285 (2014).

15. Hoffmann, K., Laperre, J., Avermaete, a, Altmeyer, P. & Gambichler, T. Defined UV protection by apparel textiles. *Arch. Dermatol.* 137, 1089-94 (2001).

16. Lu, H. F., Fei, B., Xin, J. H., Wang, R. & Li, L. Fabrication of UV-blocking nanohybrid coating via mini-emulsion polymerization. *J. Colloid Interface Sci.* 300, 111-116 (2006).

17. Tang, X. et al. Functionalization of cotton fabric with graphene oxide nanosheet & polyaniline for conductive & UV blocking properties. *Synth. Met.* 202, 82-88 (2015).

18. Wang, L. et al. Superhydrophobic and ultraviolet-blocking cotton textiles. *ACS Appl. Mater. Interfaces* 3, 1277-1281 (2011).

19. Xu, B. & Cai, Z. Trial-manufacture and UV-blocking property of ZnO nanorods on cotton fabrics. *J. Appl. Polym. Sci.* 108, 3781-3786 (2008).

20. Yadav, A. et al. Functional finishing in cotton fabrics using zinc oxide nanoparticles. in *Bulletin of Materials Science* 29, 641-645 (2006).

21. Chakrabarti, S. & Banerjee, P. Preparation and characterization of multifunctional cotton fabric by coating with sonochemically synthesized zinc oxide nanoparticle-flakes and a novel approach to monitor its self-cleaning property. *J. Text. Inst.* 106, 963-969 (2015).

22. Nourbakhsh, S., Montazer, M. & khandaghabadi, Z. Zinc oxide nano particles coating on polyester fabric functionalized through alkali treatment. *J. Ind. Text.* 47, 1006-1023 (2018).

23. Shateri-Khalilabad, M. & Yazdanshenas, M. E. Bifunctionalization of cotton textiles by ZnO nanostructures: Antimicrobial activity and ultraviolet protection. *Text. Res. J.* 83, 993-1004 (2013).

24. RongHua, W., XiaoWen, W. & H, X. J. Advanced Visible Light Self-cleaning Treatment for Textile Materials. in *86th Textile Institute World Conference, Vol* 2, *Conference Proceedings* (2008).

25. Wang, R., Wang, X. & Xin, J. H. Advanced visible-light-driven self-cleaning cotton by Au/TiO 2/SiO2 photocatalysts. *ACS Appl. Mater. Interfaces* 2, 82-85 (2010).

26. Gambichler, T., Altmeyer, P. & Hoffmann, K. Role of clothes in sun protection. *Recent results cancer Res. Fortschritte der Krebsforsch. Prog. dans les Rech. sur le cancer* 160, 15-25 (2002).

27. Paul, R. et al. Nano-cotton Fabrics with High Ultraviolet Protection. *Text. Res. J.* 80, 454-462 (2010).

28. Karimi, L., Yazdanshenas, M. E., Khajavi, R., Rashidi, A. & Mirjalili, M. Functional finishing of cotton fabrics using graphene oxide nanosheets decorated with titanium dioxide nanoparticles. *J. Text. Inst.* 107, (2016).

29. Zhou, Z., Zhao, Y. & Cai, Z. Low-temperature growth of ZnO nanorods on PET fabrics with two-step hydrothermal method. *Appl. Surf Sci.* 256, 4724-4728 (2010).

30. Zhu, C. et al. Design and characterization of self-cleaning cotton fabrics exploiting zinc oxide nanoparticle-triggered photocatalytic degradation. *Cellulose* 24, 2657-2667 (2017).

31. Shahid ul, I. et al. Silver nanomaterials as future colorants & potential antimicrobial agents for natural & synthetic textile materials. *RSC Adv.* 6, 44232-44247 (2016).

32. Grancarić, A. M., Tarbuk, A. & Botteri, L. Light conversion and scattering in UV protective textiles. *Autex Res. J.* 14, 247-258 (2014).

33. Li, G. et al. Chemical assembly of $TiO_2$ and $TiO_2$@Ag nanoparticles on silk fiber to produce multifunctional fabrics. *J. Colloid Interface Sci.* 358, 307-315 (2011).

34. Ibănescu, M., Muşat, V., Textor, T., Badilita, V. & Mahltig, B. Photocatalytic and antimicrobial Ag/ZnO nanocomposites for functionalization of textile fabrics. *J. Alloys Compd.* 610, 244-249 (2014).

35. Chen, L. et al. Electrical and mechanical self-healing membrane using gold nanoparticles as localized "nanoheaters". *J. Mater. Chem. C* 4, 10018-10025 (2016).

36. Becheri, A., Dürr, M., Lo Nostro, P. & Baglioni, P. Synthesis and characterization of zinc oxide nanoparticles: Application to textiles as UV-absorbers. *J. Nanoparticle Res.* 10, 679-689 (2008).

37. Staneva, D., Atanasova, D., Vasileva-Tonkova, E., Lukanova, V. & Grabchev, I. A cotton fabric modified with a hydrogel containing ZnO nanoparticles. Preparation and properties study. *Appl. Surf Sci.* 345, 72-80 (2015).

38. Shao, D., Gao, Y., Cao, K. & Wei, Q. Rapid surface functionalization of cotton fabrics by modified hydrothermal synthesis of *ZnO. J. Text. Inst.* 108, 1391-1397 (2017).

39. Shaheen, T. I., El-Naggar, M. E., Abdelgawad, A. M. & Hebeish, A. Durable antibacterial and UV protections of in situ synthesized zinc oxide nanoparticles onto cotton fabrics. *Int. J. Biol. Macromol.* 83, 426-432 (2016).

40. Montazer, M. & Maali Amiri, M. ZnO nano reactor on textiles and polymers: Ex situ and in situ synthesis, application, and characterization. *J. Phys. Chem. B* 118, 1453-1470 (2014).

41. Kang, K., Kim, S.-K., Kim, C.-J. & Jo, M.-H. The role of NiOx overlayers on spontaneous growth of NiSix nanowires from Ni seed layers. *Nano Lett.* 8, 431-6 (2008).

42. Fiordalice, R. W., Hegde, R. I. & Kawasaki, H. Orientation Control of Chemical Vapor Deposition TiN Film for Barrier Applications. *J. Electrochem. Soc.* 143, 2059-2063 (1996).

43. Calestani, D., Dhanabalan, S. C., Villani, M., Lazzarini, L. & Zappettini, A. InZnO nanorods obtained via zinc vapour phase deposition on liquid indium seeded substrates. *CrystEngComm* 16, (2014).

44. Rathmell, A. R., Bergin, S. M., Hua, Y.-L., Li, Z.-Y. & Wiley, B. J. The Growth Mechanism of Copper Nanowires and Their Properties in Flexible, Transparent Conducting Films. *Adv. Mater.* 22, 3558-3563 (2010).

45. Wang, H. et al. Rutile TiO2 nano-branched arrays on FTO for dye-sensitized solar cells. *Phys. Chem. Chem. Phys.* 13, 7008 (2011).

46. Bajzik, V., Hes, L. & Dolezal, I. Changes in thermal comfort properties of sports wear & underwear due to their wetting. *Indian J. Fibre Text. Res.* 44, 161-66 (2016).

47. Ding, J., Liu, Y., Tan, C. & Yuan, N. Investigations into the impact of various substrates and ZnO ultra thin seed layers prepared by atomic layer deposition on growth of ZnO nanowire array. *Nanoscale Res. Lett.* 7, 368 (2012).

48. Noor, N. et al. Influencing FTO thin film growth with thin seeding layers: a route to microstructural modification. *J. Mater. Chem. C* 3, 9359-9368 (2015).

49. Noor, N. & Parkin, I. P. Enhanced transparent-conducting fluorine-doped tin oxide films formed by Aerosol-Assisted Chemical Vapour Deposition. *J. Mater. Chem. C* 1, 984-996 (2013).

50. Noor, N. & Parkin, I. P. Halide doping effects on transparent conducting oxides formed by aerosol assisted chemical vapour deposition. *Thin Solid Films* 532, 26-30 (2013).

51. Sotelo-Vazquez, C. et al. Multifunctional P-doped $TiO_2$ Films: A new approach to self-cleaning, transparent conducting oxide materials. *Chem. Mater.* 27, 3234-3242 (2015).

52. Chen, S., Noor, N., Parkin, I. P. & Binions, R. Temperature and thickness-dependent growth behaviour and opto-electronic properties of Ga-doped ZnO films prepared by aerosol-assisted chemical vapour deposition. *J. Mater. Chem. A* 2, 17174-17182 (2014).

53. He, G. et al. One pot synthesis of nickel foam supported self-assembly of $NiWO_4$ & $CoWO_4$ nanostructures that act as high performance electrochemical capacitor electrodes. *J. Mater. Chem. A* 3, 14272-14278 (2015).

54. Kafizas, A., Noor, N., Carmalt, C. J. & Parkin, I. P. $TiO_2$-based transparent conducting oxides; the search for optimum electrical conductivity using a combinatorial approach. *J. Mater. Chem. C* 1, 6335-6346 (2013).

55. Kafizas, A. et al. Combinatorial atmospheric pressure chemical vapor deposition of F:TiO2; The relationship between photocatalysis & transparent conducting oxide properties. *Adv. Funct. Mater.* 24, 1758-1771 (2014).

56. Li, W. et al. Enhanced adsorption capacity of ultralong hydrogen titanate nanobelts for antibiotics. *J. Mater. Chem. A* 5, 4352-4358 (2017).

57. Knapp, C. E., Dyer, C., Chadwick, N. P., Hazael, R. & Carmalt, C. J. Metal β-diketoiminate precursor use in aerosol assisted chemical vapour deposition of gallium- and aluminium-doped zinc oxide. *Polyhedron* 140, 35-41 (2018).

58. Drosos, C. & Vernardou, D. Perspectives of energy materials grown by APCVD. *Sol. Energy Mater. Sol. Cells* 140, 1-8 (2015).

59. Diesen, V., Jonsson, M. & Parkin, I. P. Improved texturing and photocatalytic efficiency in TiO2 films grown using aerosol-assisted CVD and atmospheric pressure CVD. *Chem. Vap. Depos.* 19, 355-362 (2013).

60. Ling, X. et al. Role of the Seeding Promoter in MoS 2 Growth by Chemical Vapor Deposition. *Nano Lett.* 14, 464-472 (2014).

61. Heath, J. R., Gates, S. M. & Chess, C. A. Nanocrystal seeding: A low temperature route to polycrystalline Si films. *Appl. Phys. Lett.* 64, 3569-3571 (1994).

62. Yu, K. M. et al. Ideal transparent conductors for full spectrum photovoltaics. *J. Appl. Phys.* 111, 123505 (2012).

63. Lopez, N., Reichertz, L. A., Yu, K. M., Campman, K. & Walukiewicz, W. Engineering the electronic band structure for multiband solar cells. *Phys. Rev. Lett.* 106, (2011).

64. Ellmer, K. Past achievements & future challenges in the development of optically transparent electrodes. *Nat. Photonics* 6, 808-816 (2012).

65. Dixon, S. C., Scanlon, D. O., Carmalt, C. J. & Parkin, I. P. n-Type doped transparent conducting binary oxides: an overview. *J. Mater. Chem. C* 419, 462-465 (2016).

66. Lee, K. M., Lai, C. W., Ngai, K. S. & Juan, J. C. Recent Developments of Zinc Oxide Based Photocatalyst in Water Treatment Technology: A Review. *Water Res.* 88, 428-448 (2015).

67. Ponja, S. D., Sathasivam, S., Parkin, I. P. & Carmalt, C. J. Transparent conductive aluminium & fluorine co-doped zinc oxide films via aerosol assisted chemical vapour deposition. *RSC Adv.* 4, 49723-49728 (2014).

68. Walters, G. & Parkin, I. P. Aerosol assisted chemical vapour deposition of ZnO films on glass with noble metal & p-type dopants; use of dopants to influence preferred orientation. *Appl. Surf Sci.* 255, 6555-6560 (2009).

69. Bhachu, D. S., Sankar, G. & Parkin, I. P. Aerosol assisted chemical vapor deposition of transparent conductive zinc oxide films. *Chem. Mater.* 24, 4704-4710 (2012).

70. Chen, S., Wilson, R. M. & Binions, R. Synthesis of highly surface-textured ZnO thin films by aerosol assisted chemical vapour deposition. *J. Mater. Chem. A* 3, 5794-5797 (2015).

71. Zou, R. et al. ZnO nanorods on reduced graphene sheets with excellent field emission, gas sensor and photocatalytic properties. *J. Mater. Chem. A* 1, 8445 (2013).

72. Kolodziejczak-Radzimska, A. & Jesionowski, T. Zinc oxide—from synthesis to application: A review. *Materials (Basel).* 7, 2833-2881 (2014).

73. Zhang, D. et al. In situ generation and deposition of nano-ZnO on cotton fabric by hyperbranched polymer for its functional finishing. Text. Res. J. 83, 1625-1633 (2013).

74. Liew, L. L., Sankar, G., Handoko, A. D., Goh, G. K. L. & Kohara, S. Understanding the defect structure of solution grown zinc oxide. in *Journal of Solid State Chemistry* 189, 63-67 (2012).

75. Dixon, S. C. et al. Transparent conducting n-type ZnO:Sc—synthesis, optoelectronic properties and theoretical insight. *J. Mater. Chem. C* 5, 7585-7597 (2017).

76. Hassan, I. A., Sathasivam, S., Nair, S. P. & Carmalt, C. J. Antimicrobial Properties of Copper-Doped ZnO Coatings under Darkness and White Light Illumination. *ACS Omega* 2, 4556-4562 (2017).

77. Manaia, E. B., Kaminski, R. C. K., Corrêa, M. A. & Chiavacci, L. A. Inorganic UV filters. Brazilian *J. Pharm. Sci.* 49, 201-209 (2013).

78. Jafari-Kiyan, A., Karimi, L. & Davodiroknabadi, A. Producing colored cotton fabrics with functional properties by combining silver nanoparticles with nano titanium dioxide. *Cellulose* 24, 3083-3094 (2017).

79. Zhang, G., Liu, Y., Morikawa, H. & Chen, Y. Application of ZnO nanoparticles to enhance the antimicrobial activity and ultraviolet protective property of bamboo pulp fabric. *Cellulose* (2013). doi:10.1007/s10570-013-9979-2

80. Zhang, F., Wu, X., Chen, Y. & Lin, H. Application of silver nanoparticles to cotton fabric as an antibacterial textile finish. *Fibers Polym.* (2009). doi:10.1007/s12221-009-0496-8

81. Zhang, G., Liu, Y., Gao, X. & Chen, Y. Synthesis of silver nanoparticles and antibacterial property of silk fabrics treated by silver nanoparticles. *Nanoscale Res. Lett.* (2014). doi:10.1186/1556-276X-9-216

82. Mitrano, D. M., Limpiteeprakan, P., Babel, S. & Nowack, B. Durability of nano-enhanced textiles through the life cycle: Releases from landfilling after washing. *Environ. Sci. Nano* (2016). doi:10.1039/c6en00023a The aforementioned references are hereby incorporated by reference in their entirety.

INDUSTRIAL APPLICABILITY

Provided herein is a method for preparing metal coated textile substrates with numerous potential applications, such as in recreational clothing, protective clothing, medical textiles, electronic skins, and reversible biosensors etc. The metal coated textile substrates prepared according to the methods described herein can also find use in sanitary, medical applications, as well as personal and home care products.

What is claimed is:

1. A method for preparing a metal coated textile substrate comprising:

providing an aqueous seeding solution comprising a first metal precursor and a first metal precursor reactant, wherein the first metal precursor is $AgNO_3$ and the first metal precursor reactant is ethylene glycol, wherein the $AgNO_3$ is present in the aqueous seeding solution at a concentration of 0.0215 M to 0.043 M and the ethylene glycol is present in the aqueous seeding solution at a concentration of 40-80% v/v;

irradiating the aqueous seeding solution by a first ultrasonic irradiation reaction process thereby forming a first plurality of metal nanoparticles;

depositing the first plurality of metal nanoparticles on a textile substrate by a first ultrasonic irradiation deposition process thereby forming a metal seeded textile substrate;

providing an aqueous coating solution comprising a second metal precursor, a second metal precursor reactant, and $Fe(NO_3)_3$, wherein the second metal precursor is $Zn(OAc)_2$ and the second metal precursor reactant is an alkali metal hydroxide, wherein the $Zn(OAc)_2$ is present in the aqueous coating solution at a concentration of 0.1 M to 0.6 M; the alkali metal hydroxide is present in the aqueous coating solution at a concentration of 0.4 M to 0.6 M; and the $Fe(NO_3)_3$ is present in the aqueous coating solution at a concentration of 0.01 M to 0.05 M;

irradiating the aqueous coating solution by a second ultrasonic irradiation reaction process thereby forming a second plurality of metal nanoparticles; and depositing the second plurality of metal nanoparticles on the metal seeded textile substrate by a second ultrasonic irradiation deposition process thereby forming the metal coated textile substrate.

2. The method of claim 1, wherein the $AgNO_3$ is present in the aqueous seeding solution at a concentration of 0.043 M and the $Fe(NO_3)_3$ is present in the aqueous coating solution at a concentration of 0.01 M to 0.02 M.

3. The method of claim 1, wherein the first ultrasonic irradiation deposition process comprises ultrasonic wave irradiation at a frequency of 20-25 kHz and a power of 730 to 770 W at between 40% and 60% ultrasound amplitude and the second ultrasonic irradiation deposition process comprises ultrasonic wave irradiation at a frequency of 20-25 kHz and a power of 730 to 770 W at between 30% and 50% ultrasound amplitude.

4. The method of claim 3, wherein the first ultrasonic irradiation deposition process and the second ultrasonic irradiation deposition process are each independently less than 90 minutes.

5. The method of claim 1, wherein the metal coated textile substrate comprises substantially pure phase ZnO.

* * * * *